US012690613B2

(12) United States Patent
Lau et al.

(10) Patent No.: US 12,690,613 B2
(45) Date of Patent: Jul. 28, 2026

(54) CAPSULES, HEAT-NOT-BURN (HNB) AEROSOL-GENERATING DEVICES, AND METHODS OF GENERATING AN AEROSOL

(71) Applicant: Altria Client Services LLC, Richmond, VA (US)

(72) Inventors: Raymond W. Lau, Richmond, VA (US); Eric Hawes, Midlothian, VA (US); James McLaren, Richmond, VA (US); Shaoyong Yu, Glen Allen, VA (US); Rangaraj S. Sundar, Richmond, VA (US); Zack W. Blackmon, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 310 days.

(21) Appl. No.: 17/579,439

(22) Filed: Jan. 19, 2022

(65) Prior Publication Data

US 2023/0225401 A1 Jul. 20, 2023

(51) Int. Cl.

| | |
|---|---|
| ***A24F 40/42*** | (2020.01) |
| ***A24F 40/20*** | (2020.01) |
| ***A24F 40/46*** | (2020.01) |

(52) U.S. Cl.

CPC ..... *A24F 40/42* (2020.01); *A24F 40/20* (2020.01); *A24F 40/46* (2020.01)

(58) Field of Classification Search

CPC ..... A24F 40/42; A24F 40/46; A24F 40/20

See application file for complete search history.

(56) References Cited

U.S. PATENT DOCUMENTS

| | | | |
|---|---|---|---|
| 5,353,813 | A | 10/1994 | Deevi et al. |
| 8,430,106 | B2 | 4/2013 | Potter et al. |
| 10,028,534 | B2 | 7/2018 | Sur |
| 10,412,995 | B2 | 9/2019 | Macko |
| 10,463,076 | B2 | 11/2019 | Garthaffner et al. |
| 10,638,791 | B2 | 5/2020 | Plews et al. |
| 10,653,184 | B2 | 5/2020 | Chang et al. |

(Continued)

FOREIGN PATENT DOCUMENTS

| | | | |
|---|---|---|---|
| CN | 109090708 | A | 12/2018 |
| GB | 2473264 | A | 3/2011 |

(Continued)

OTHER PUBLICATIONS

The Engineering ToolBox (2005). Metals, Metallic Elements and Alloys—Thermal Conductivities. [online] Available at: https://www.engineeringtoolbox.com/thermal-conductivity-metals-d_858.html [Accessed Jan. 4, 2024] (Year: 2005).*

(Continued)

*Primary Examiner* — Katherine A Will

(74) *Attorney, Agent, or Firm* — HARNESS, DICKEY & PIERCE, P.L.C.

(57) ABSTRACT

A capsule for a heat-not-burn (HNB) aerosol-generating device may include an inner body, an outer body around the inner body, the inner body and the outer body being concentric, the inner body and the outer body at least partly defining a cavity, an aerosol-forming substrate in the cavity, a first cap at a first end of the cavity and a second cap at a second end of the cavity, the first and second caps being configured to permit air flow from the first end of the cavity to the second end of the cavity.

18 Claims, 22 Drawing Sheets

(56) References Cited

U.S. PATENT DOCUMENTS

| | | | | |
|---|---|---|---|---|
| 10,721,968 | B2 | 7/2020 | Dooly et al. | |
| 2006/0191546 | A1 | 8/2006 | Takano et al. | |
| 2014/0261487 | A1 | 9/2014 | Chapman et al. | |
| 2017/0071253 | A1 | 3/2017 | Revell | |
| 2017/0119049 | A1* | 5/2017 | Blandino | A24D 1/042 |
| 2017/0280769 | A1* | 10/2017 | Li | A24B 15/283 |
| 2019/0281896 | A1 | 9/2019 | Chapman et al. | |
| 2020/0060352 | A1 | 2/2020 | Garthaffner et al. | |
| 2020/0231369 | A1 | 7/2020 | Caldas | |
| 2021/0015173 | A1* | 1/2021 | Cox | A24B 15/165 |
| 2021/0378309 | A1* | 12/2021 | Reevell | A24F 40/46 |

FOREIGN PATENT DOCUMENTS

| | | | |
|---|---|---|---|
| WO | WO-2018114313 | A1 | 6/2018 |
| WO | WO-2018228131 | A1 | 12/2018 |
| WO | WO-2019073237 | A1 | 4/2019 |
| WO | WO-2019110669 | A1 | 6/2019 |
| WO | WO-2020025738 | A2 | 2/2020 |
| WO | WO-2020074595 | A1 | 4/2020 |
| WO | WO-2021009714 | A1 | 1/2021 |

OTHER PUBLICATIONS

International Search Report and Written Opinion dated May 3, 2023.

* cited by examiner

CAPSULES, HEAT-NOT-BURN (HNB) AEROSOL-GENERATING DEVICES, AND METHODS OF GENERATING AN AEROSOL

BACKGROUND

Field

The present disclosure relates to capsules, heat-not-burn (HNB) aerosol-generating devices, and methods of generating an aerosol without involving a substantial pyrolysis of the aerosol-forming substrate.

Description of Related Art

Some electronic devices are configured to heat a plant material to a temperature that is sufficient to release constituents of the plant material while keeping the temperature below its ignition temperature so as to avoid a self-sustaining burning or a self-sustaining combustion of the plant material (i.e., in contrast to where a plant material is lit, such as lit-end cigarettes). Such devices may be characterized as generating an aerosol of constituents released by heating, and may be referred to as heat-not-burn aerosol-generating devices, or heat-not-burn devices.

It is understood that heating of a plant material below its ignition temperature may, in some circumstances, produce incidental and insubstantial levels of oxidized or other thermal decomposition byproducts. However, in some embodiments, the heating in aerosol-generating devices is below the pyrolysis temperature of the plant material so as to produce an aerosol having no or insubstantial levels of thermal decomposition byproducts of the plant material. Thus, in an example embodiment, pyrolysis of the plant material does not occur during the heating and resulting production of aerosol. In other instances, there may be incidental pyrolysis, with production of oxidized or other thermal decomposition byproducts at levels that are insignificant relative to the primary constituents released by heating of the plant materials.

SUMMARY

At least one embodiment relates to a capsule for a heat-not-burn (HNB) aerosol-generating device. In an example embodiment, the capsule may include an inner body, an outer body around the inner body, the inner body and the outer body being concentric, the inner body and the outer body at least partly defining a cavity, an aerosol-forming substrate in the cavity, a first cap at a first end of the cavity and a second cap at a second end of the cavity, the first and second caps being configured to permit air flow from the first end of the cavity to the second end of the cavity.

In at least one example embodiment, the inner body has a higher heat conductivity than the outer body.

In at least one example embodiment, the inner body defines an inner receiving area and the inner body includes a plurality of projections facing the inner receiving area, the cavity and the inner receiving area being on opposing sides of the inner body.

In at least one example embodiment, a longitudinal axis of the plurality of projections extends along a length of the inner body.

In at least one example embodiment, the plurality of projections have a rectangular cross-section.

In at least one example embodiment, the plurality of projections have a curved cross-section.

In at least one example embodiment, the second cap includes a plurality of apertures in a circular pattern.

In at least one example embodiment, the second cap includes a plurality of apertures, a length of the plurality of apertures being normal to a radius of the second cap.

In at least one example embodiment, the second cap includes a plurality of apertures, a length of the plurality of apertures being in a radial direction of the second cap.

In at least one example embodiment, the inner body is on the second cap.

In at least one example embodiment, the inner body includes a plurality of layers.

At least one embodiment relates to an aerosol-generating device including a capsule, the capsule including an inner body, the inner body defining an inner space, an outer body around the inner body, the inner body and the outer body being concentric, the inner body and the outer body at least partly defining a cavity, an aerosol-forming substrate in the cavity, a first cap at a first end of the cavity, and a second cap at a second end of the cavity, the first and second caps being configured to permit air flow from the first end of the cavity to the second end of the cavity. The aerosol-generating device further includes a heater dimensioned to fit in the inner space and contact the inner body, the heater being configured to heat the inner body to generate an aerosol from the aerosol-forming substrate.

In at least one example embodiment, the inner body has a higher heat conductivity than the outer body.

In at least one example embodiment, the inner body defines an inner receiving area and the inner body includes a plurality of projections facing the inner receiving area, the cavity and the inner receiving area being on opposing sides of the inner body.

In at least one example embodiment, a longitudinal axis of the plurality of projections extends along a length of the inner body.

In at least one example embodiment, the plurality of projections have a rectangular cross-section.

In at least one example embodiment, the plurality of projections have a curved cross-section.

In at least one example embodiment, the second cap includes a plurality of apertures in a circular pattern.

In at least one example embodiment, the second cap includes a plurality of apertures, a length of the plurality of apertures being normal to a radius of the second cap.

In at least one example embodiment, the second cap includes a plurality of apertures, a length of the plurality of apertures being in a radial direction of the second cap.

In at least one example embodiment, the inner body is on the second cap.

In at least one example embodiment, the inner body includes a plurality of layers.

In at least one example embodiment, an inner diameter of the inner body expands to correspond to a diameter of the heater upon insertion of the heater.

In at least one example embodiment, the aerosol-generating device further includes a mouthpiece coupled to the capsule.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1A:
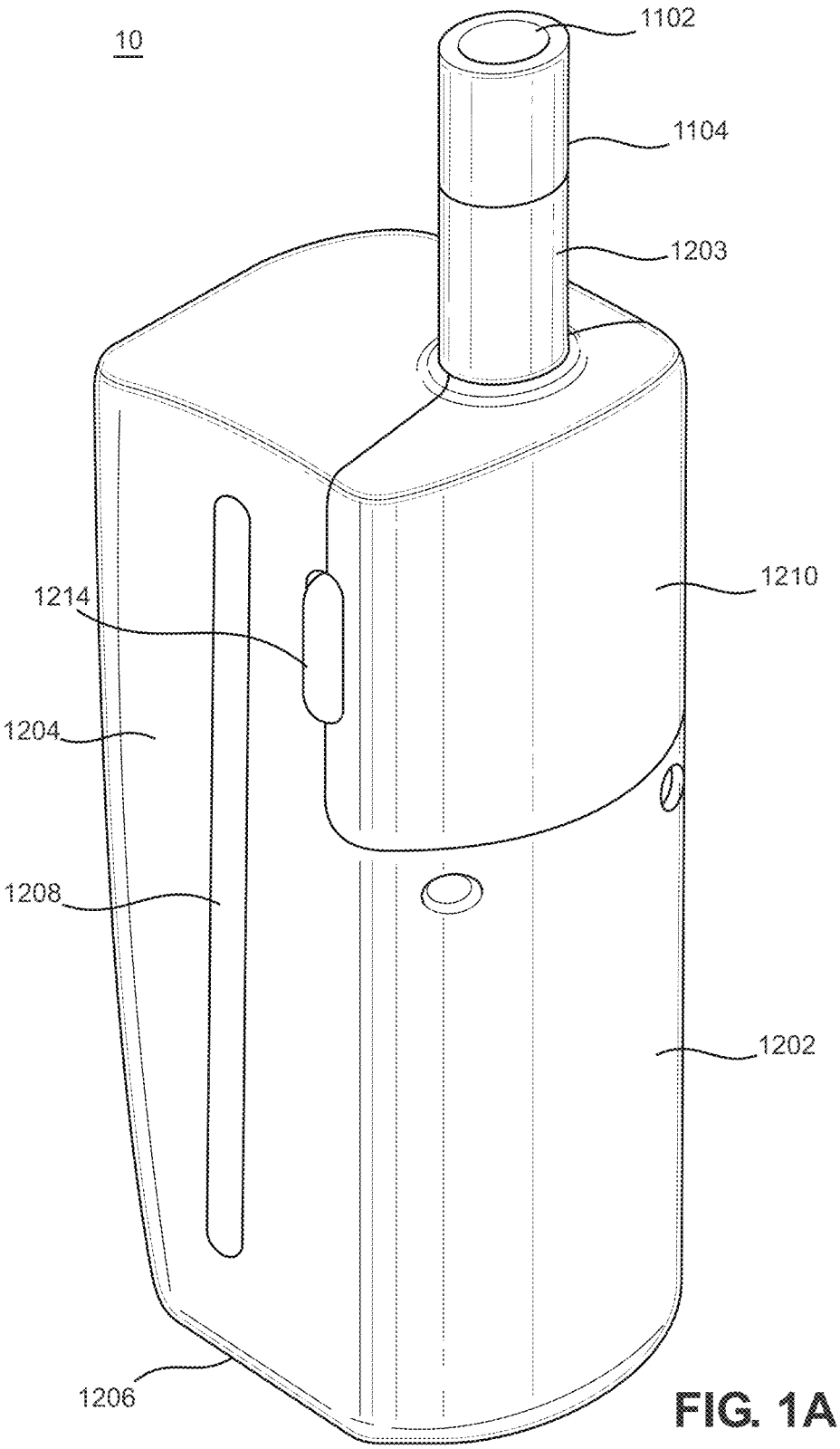
FIGS. 1A-1G illustrate an aerosol-generating device according to at least one example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," "attached to," "adjacent to," or "covering" another element or layer, it may be directly on, connected to, coupled to, attached to, adjacent to or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Hardware may be implemented using processing or control circuitry such as, but not limited to, one or more processors, one or more Central Processing Units (CPUs), one or more microcontrollers, one or more arithmetic logic units (ALUs), one or more digital signal processors (DSPs), one or more microcomputers, one or more field programmable gate arrays (FPGAs), one or more System-on-Chips (SoCs), one or more programmable logic units (PLUs), one or more microprocessors, one or more Application Specific Integrated Circuits (ASICs), or any other device or devices capable of responding to and executing instructions in a defined manner.

FIGS. 1A-1G illustrate an aerosol-generating device according to at least one example embodiment.

Figure 1B:
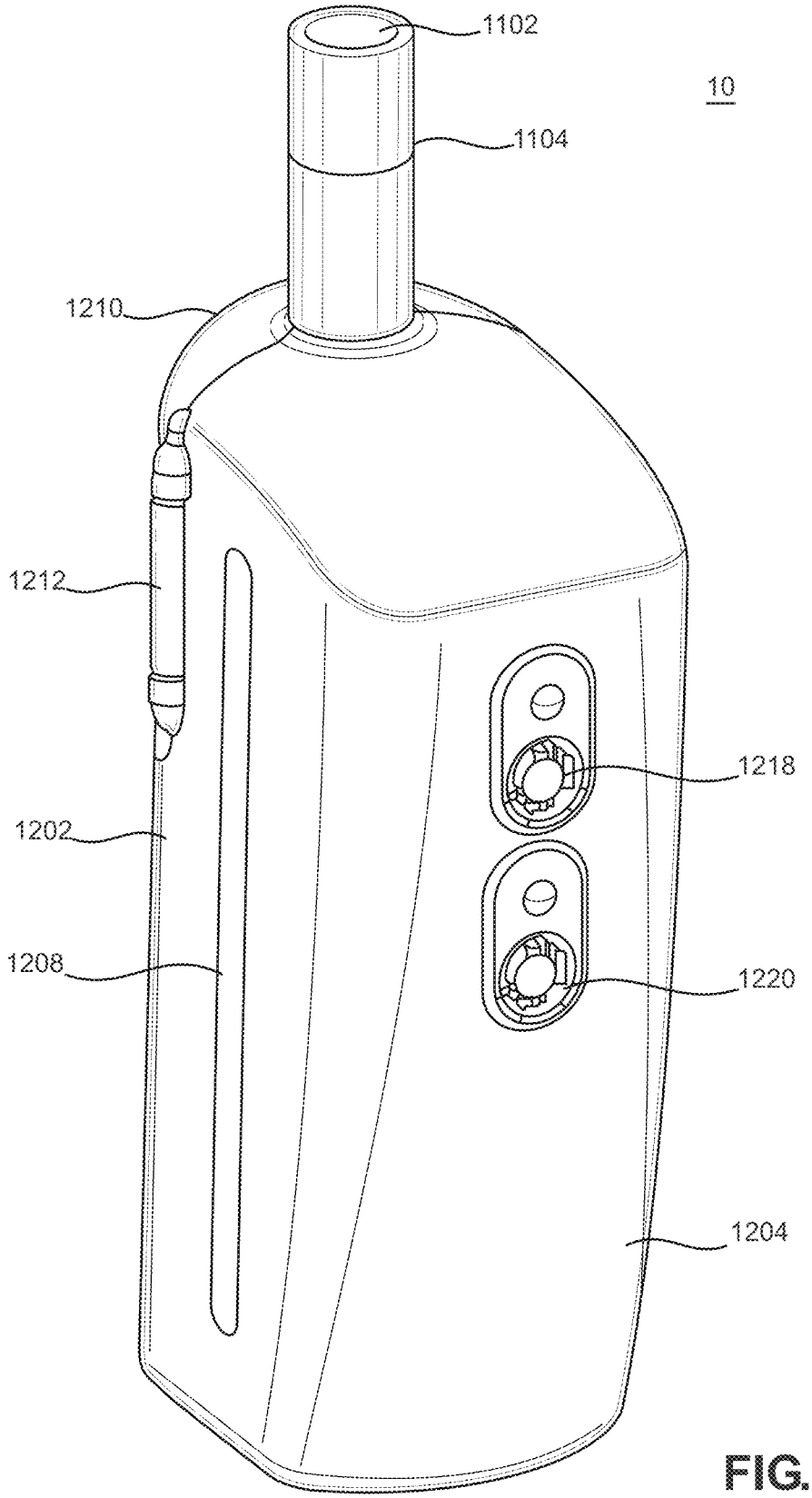
Figure 1C:
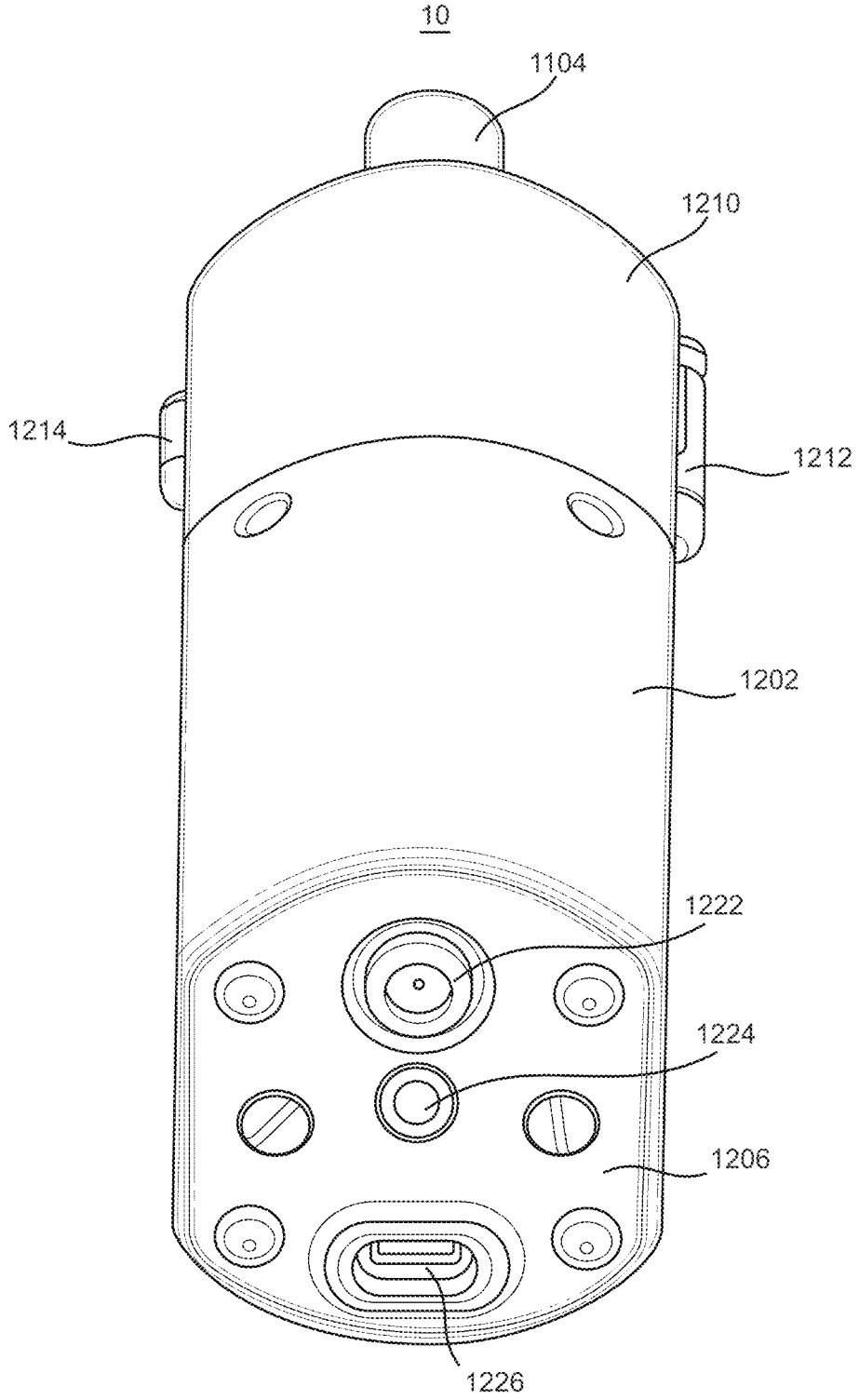

FIG. 1A is a front perspective view of an aerosol-generating device according to an example embodiment. FIG. 1B is a rear perspective view of the aerosol-generating device of FIG. 1A. FIG. 1C is an upstream perspective view of the aerosol-generating device of FIG. 1A. Referring to FIGS. 1A-C, an aerosol-generating device 10 is configured to receive and heat an aerosol-forming substrate to produce an aerosol. The aerosol-generating device 10 includes, inter alia, a front housing 1202, a heating module 1203, a rear housing 1204, and a bottom housing 1206 coupled to a frame 1208 (e.g., chassis). A door 1210 is also pivotally connected/attached to the front housing 1202. For instance, the door 1210 is configured to move or swing about a hinge 1212 and configured to reversibly engage/disengage with the front housing 1202 via a latch 1214 in order to transition between an open position and a closed position. The aerosol-forming substrate, which may be contained within a capsule 100 (e.g., FIG. 3A), may be loaded into the aerosol-generating device 10 via the heating module 1203. During an operation of the aerosol-generating device 10, the aerosol produced may be drawn from the aerosol-generating device 10 via the aerosol outlet 1102 defined by the mouthpiece 1104 of the mouthpiece 1100 (e.g., FIG. 1G).

As illustrated in FIG. 1B, the aerosol-generating device 10 includes a first button 1218 and a second button 1220. The first button 1218 may be a pre-heat button, and the second button 1220 may be a power button (or vice versa). Additionally, one or both of the first button 1218 and the second button 1220 may include a light-emitting diode (LED) configured to emit a visible light when the first button 1218 and/or the second button 1220 is pressed. Where both of the first button 1218 and the second button 1220 includes an LED, the lights emitted may be of the same color or of different colors. The lights may also be of the same intensity or of different intensities. Furthermore, the lights may be configured as continuous lights or intermittent lights. For instance, the light in connection with the power button (e.g., second button 1220) may blink/flash to indicate that the power supply (e.g., battery) is low and in need charging. While the aerosol-generating device 10 is shown as having two buttons, it should be understood that more (e.g., three) or less buttons may be provided depending on the desired interface and functionalities.

The aerosol-generating device 10 may have a cuboid-like shape which includes a front face, a rear face opposite the front face, a first side face between the front face and the rear face, a second side face opposite the first side face, a downstream end face, and an upstream end face opposite the downstream end face. As used herein, "upstream" (and, conversely, "downstream") is in relation to a flow of the aerosol, and "proximal" (and, conversely, "distal") is in relation to an adult operator of the aerosol-generating device 10 during aerosol generation. Although the aerosol-generating device 10 is illustrated as having a cuboid-like shape (e.g., rounded rectangular cuboid) with a polygonal cross-section, it should be understood that example embodiments are not limited thereto. For instance, in some embodiments, the aerosol-generating device 10 may have a cylinder-like shape with a circular cross-section (e.g., for a circular cylinder) or an elliptical cross-section (e.g., for an elliptic cylinder).

As illustrated in FIG. 1C, the aerosol-generating device 10 includes an inlet insert 1222 configured to permit ambient air to enter the device body 1200 (e.g., FIG. 2). In an example embodiment, the inlet insert 1222 defines an orifice as an air inlet which is in fluidic communication with the aerosol outlet 1102. As a result, when a draw (e.g., a puff) or negative pressure is applied to the aerosol outlet 1102, ambient air will be pulled into the device body 1200 via the orifice in the inlet insert 1222. The size (e.g., diameter) of the orifice in the inlet insert 1222 made be adjusted, while also taking in account other variables (e.g., capsule 100) in the flow path, to provide the desired overall resistance-to-draw (RTD). In other embodiments, the inlet insert 1222 may be omitted altogether such that the air inlet is defined by the bottom housing 1206.

The aerosol-generating device 10 may additionally include a jack 1224 and a port 1226. In an example embodiment, the jack 1224 permits the downloading of operational information for research and development (R&D) purposes (e.g., via an RS232 cable). The port 1226 is configured to receive an electric current (e.g., via a USB/mini-USB cable) from an external power supply so as to charge an internal power supply within the aerosol-generating device 10. In addition, the port 1226 may also be configured to send data to and/or receive data (e.g., via a USB/mini-USB cable) from another aerosol-generating device or other electronic device (e.g., phone, tablet, computer). Furthermore, the aerosol-generating device 10 may be configured for wireless communication with another electronic device, such as a phone, via an application software (app) installed on that electronic device. In such an instance, an adult operator may control or otherwise interface with the aerosol-generating device 10 (e.g., locate the aerosol-generating device, check usage information, change operating parameters) through the app.

Figure 1D:
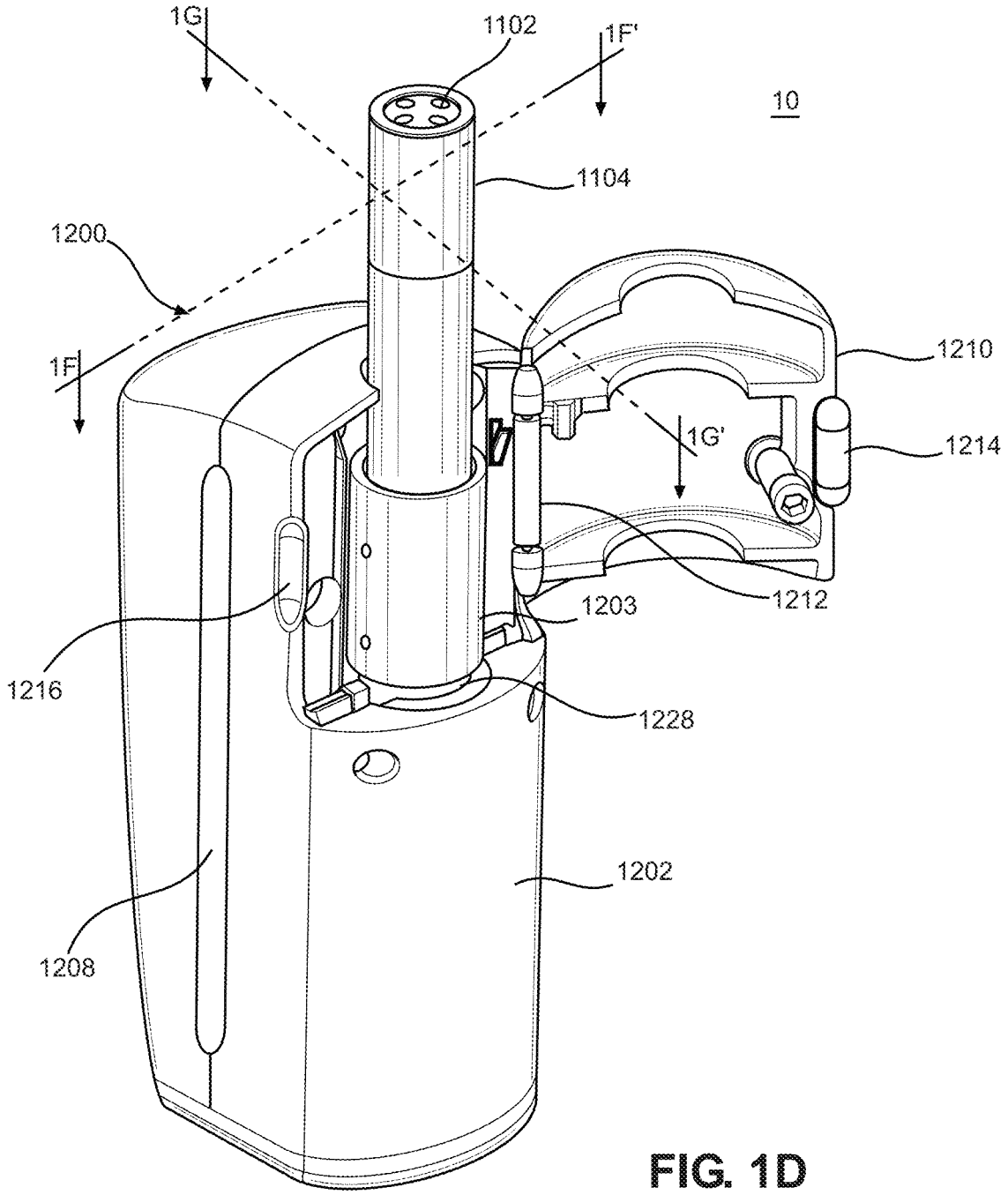
Figure 1E:
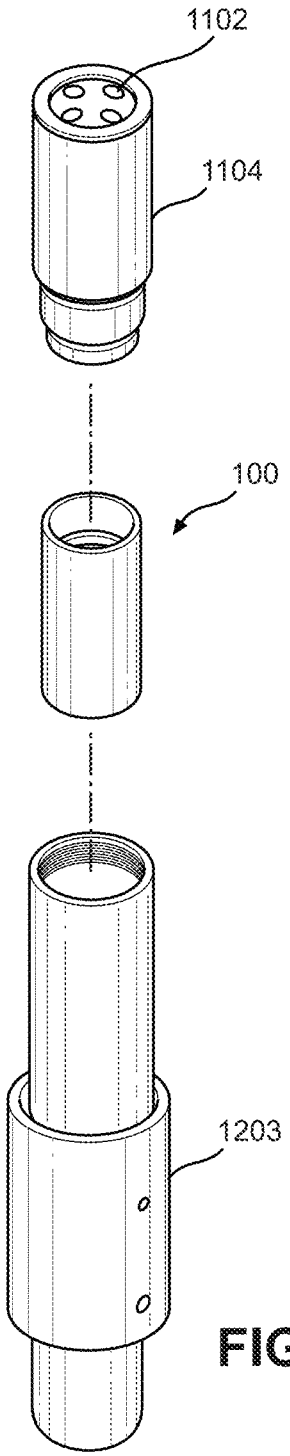

FIG. 1D is a front perspective view of the aerosol-generating device of FIGS. 1A-1C and FIG. 1E illustrates a mouthpiece 1104 and a capsule 100 are separated from the device body. Referring to FIGS. 1D-1E, the aerosol-generating device 10 includes a device body 1200 configured to receive a capsule 100 and a mouthpiece 1104. In an example embodiment, the device body 1200 defines a receptacle 1228 configured to receive the heating module 1203. The receptacle 1228 may be in a form of a cylindrical socket with outwardly-extending, diametrically-opposed side slots to accommodate the electrical end sections/contacts of the heating module 1203. However, it should be understood that the receptacle 1228 may be in other forms based on the shape/configuration of the heating module 1203.

As noted supra, the device body 1200 includes a door 1210 configured to open to permit an insertion of the capsule 100 and the mouthpiece 1104 and configured to close to retain the capsule 100. The mouthpiece 1104 includes a mouth end (e.g., at the outlet 1102) and an opposing capsule end (e.g., to interface with the capsule 100 and the heating module 1203). In an example embodiment, the capsule end is configured to prevent a disengagement of the mouthpiece 1104 from the capsule 100 and the heating module 1203 when the door 1210 of the device body 1200 is closed. When received/secured within the device body 1200 and ready for aerosol generation, the capsule 100 may be in the heating module 1203 and hidden from view while the mouthpiece 1104 defining the aerosol outlet 1102 of the mouthpiece 1100 is visible. As illustrated in the figures, the mouthpiece 1104 may be closer to the front face of the device body 1200 than the rear face.

In some instances, the device body 1200 of the aerosol-generating device 10 may optionally include a mouthpiece sensor and/or a door sensor. The mouthpiece sensor may be disposed on a rim of the receptacle 1228 (e.g., adjacent to the front face of the device body 1200). The door sensor may be disposed on a portion of the front housing 1202 adjacent to the hinge 1212 and within the swing path of the door 1210.

In an example embodiment, the mouthpiece sensor and the door sensor are spring-loaded (e.g., retractable) projections configured as safety switches. For instance, the mouthpiece sensor may be retracted/depressed (e.g., activated) when the mouthpiece 1104 is fully engaged with the capsule 100 loaded within the heating module 1203. Additionally, the door sensor may be retracted/depressed (e.g., activated) when the door 1210 is fully closed. In such instances, the control circuitry of the device body 1200 may permit an electric current to be supplied to the capsule 100 to heat the aerosol-forming substrate therein (e.g., pre-heat permitted when the first button 1218 is pressed). Conversely, the control circuitry (e.g., a controller 2105) of the device body 1200 may prevent or cease the supply of electric current when the mouthpiece sensor and/or the door sensor is not activated or deactivated (e.g., released). Thus, the heating of the aerosol-forming substrate will not be initiated if the mouthpiece 1104 is not fully inserted and/or if the door 1210 is not fully closed. Similarly, the supply of electric current to the capsule 100 will be disrupted/halted if the door 1210 is opened during the heating of the aerosol-forming substrate.

The capsule 100, which will be discussed herein in more detail (e.g., shown in FIGS. 2A-2C), generally includes a housing defining inlet openings, outlet openings, an inner wall, an outer wall and a chamber defined by the inlet openings, the outlet openings, the inner wall and the outer wall. An aerosol-forming substrate is disposed within the chamber of the housing. Additionally, a heater may extend into a space defined by the inner wall and exterior from the housing.

The control circuitry may instruct a power supply to supply an electric current to the heater. The supply of current from the power supply may be in response to a manual operation (e.g., button-activation) or an automatic operation (e.g., draw/puff-activation). As a result of the current, the capsule 100 may be heated to generate an aerosol. In addition, the change in resistance of the heater may be used to monitor and control the aerosolization temperature. The aerosol generated may be drawn from the aerosol-generating device 10 via the mouthpiece 1104. In addition, the control circuitry (e.g., a controller 2105) may supply an electric current from the power supply to the heater to maintain a temperature of the capsule 100 between draws.

Figure 1F:
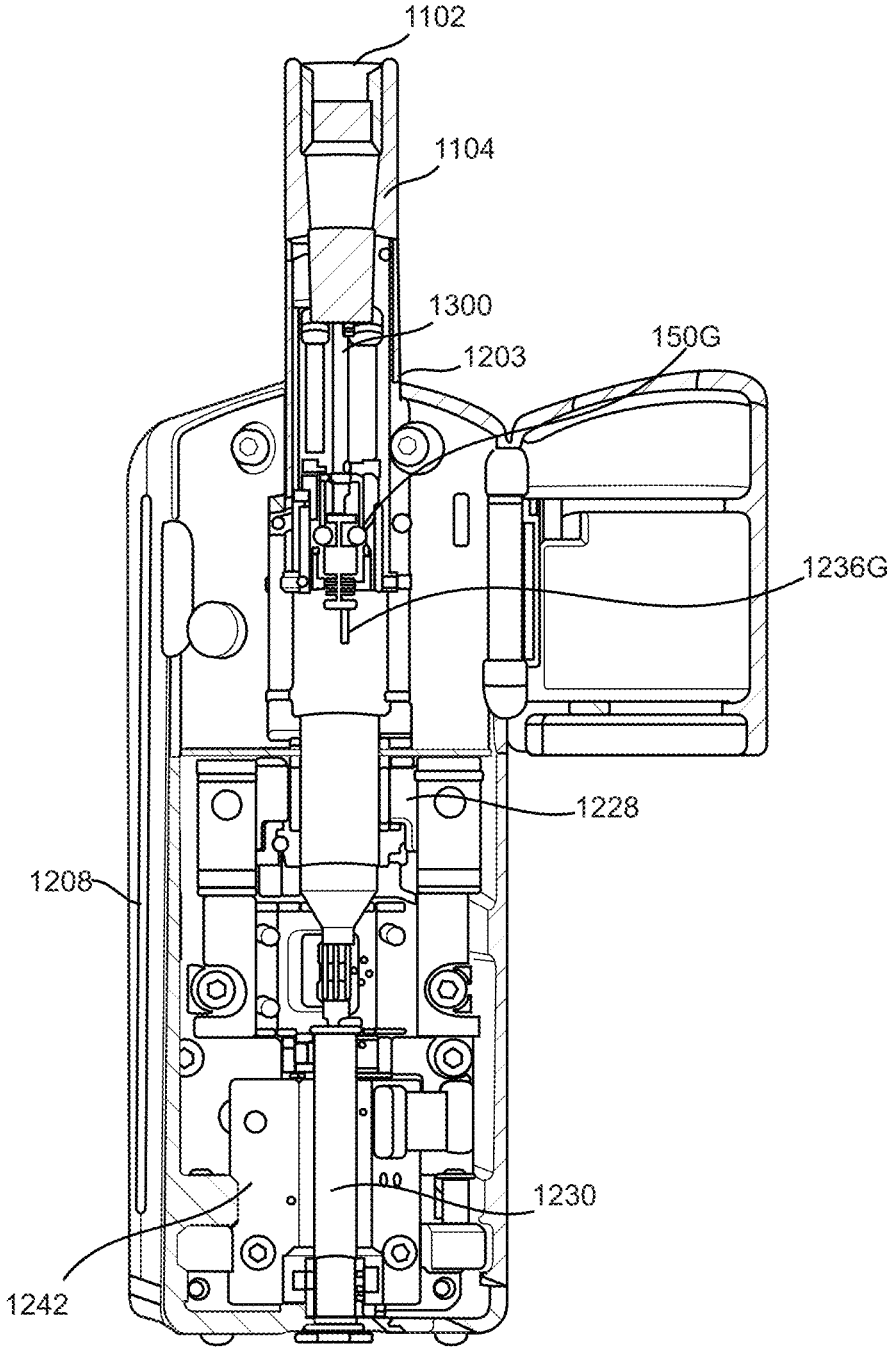
Figure 1G:
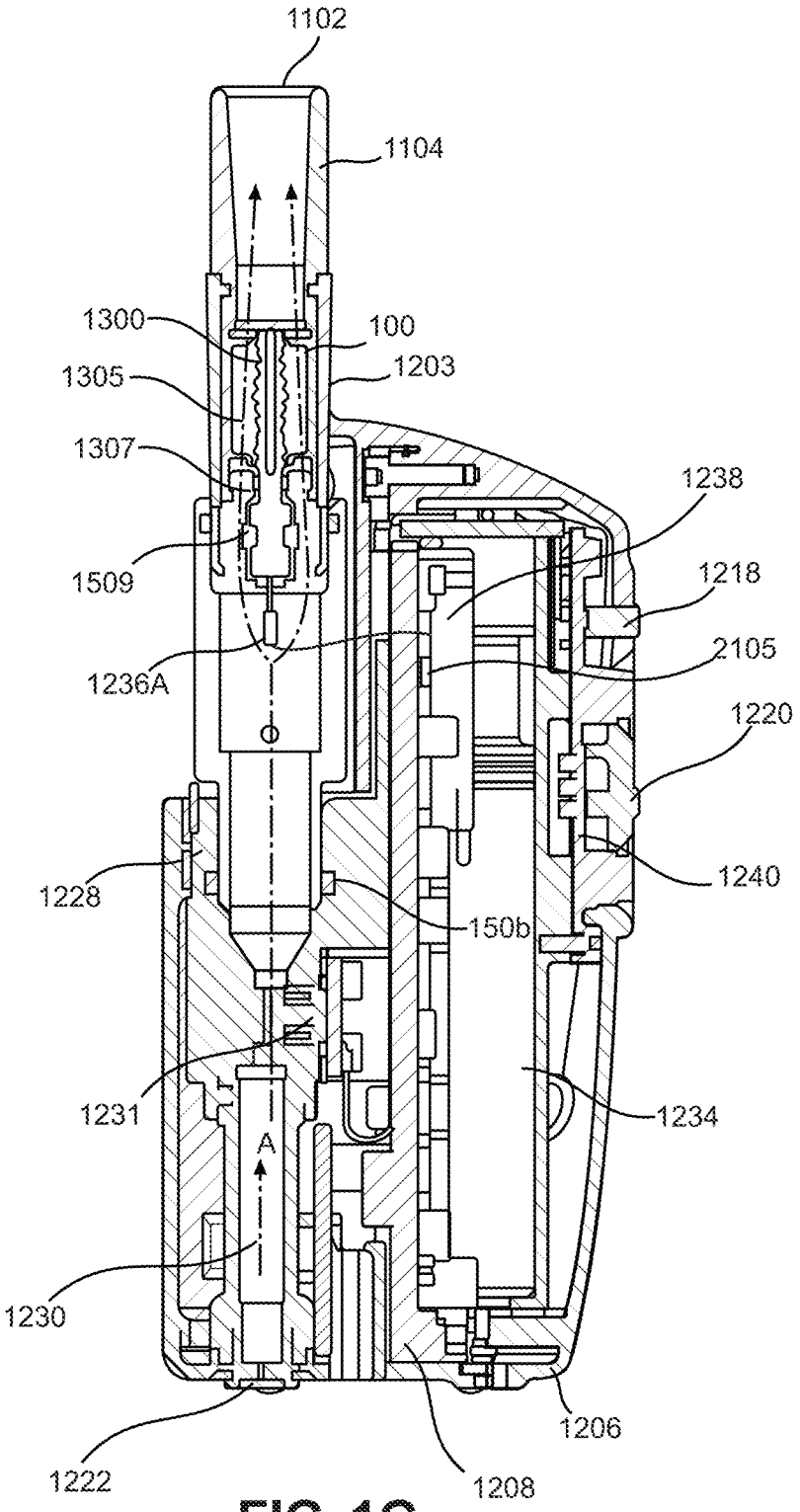

FIG. 1F is a cross-sectional view of the aerosol-generating device 10 along the line 1F-1F' in FIG. 1D. FIG. 1G is a cross-sectional view of the aerosol-generating device 10 along the line 1G-1G' in FIG. 1D. Referring to FIGS. 1F-1G, the frame 1208 (e.g., metal chassis) serves as a foundation for the internal components of the aerosol-generating device 10, which may be attached either directly or indirectly thereto. With regard to structures/components shown in the figures and already discussed above, it should be understood that such relevant teachings are also applicable to this section and may not have been repeated in the interest of brevity. In an example embodiment, the bottom housing 1206 is secured to the upstream end of the frame 1208. Between the receptacle 1228 and the bottom housing 1206 is an inlet channel 1230 configured to direct an incoming flow of ambient air to the capsule 100 in the receptacle 1228 along a path A. The inlet insert 1222, through which the incoming air may flow into the aerosol-generating device 10, may be disposed in the distal end of the inlet channel 1230. Furthermore, the receptacle 1228 and/or the inlet channel 1230 and may include a flow sensor 1231 (e.g., integrated flow sensor to detect at least one of magnitude of air flow, a direction of air flow, a pressure change, or a magnitude of pressure).

A power supply 1234 therein (e.g., FIG. 2E) may be mounted onto the rear side of the frame 1208. To establish an electrical connection with a heater 1300 in the heating module 1203 (e.g., which is in the receptacle 1228), an electric connection may be provided to facilitate the supply of an electric current. For instance, the electric connection 1236*a* may establish the requisite electrical connection between the power supply 1234 and the heater 1300 via two electrodes of the heater 1300 and control circuitry (e.g., the controller 2105) on a first printed circuit board (PCB) 1238. The electric connection 1236*a* may be a pair of wires connected to the two electrodes. However, example embodiments are not limited thereto.

The aerosol-generating device 10 may also include a plurality of printed circuit boards (PCBs) configured to facilitate its operation. In an example embodiment, the first printed circuit board 1238 (e.g., bridge PCB for power and I2C) and a second printed circuit board 1240 (e.g., human machine interface (HMI) PCB) are connected to the frame 1208. In another instance, a third printed circuit board 1242 (e.g., serial port PCB) is secured to the front of the frame 1208 and situated behind the inlet channel 1230. However, it should be understood that the example embodiments herein regarding the printed circuit boards should not be interpreted as limiting since the size, shapes, and locations thereof may vary depending on the desired features of the aerosol-generating device 10.

The PCB 1238 provides power from the power supply 1234 to the electric connection 1236*a* upon conditions for a draw being reached (e.g., power of the device is on and a predetermined pressure change is reached).

The mouthpiece 1104 defines an aerosol outlet 1102 in the form of a single outlet or a plurality of smaller outlets (e.g., two to six outlets). In one instance, the plurality of outlets may be in the form of four outlets. The outlets may be radially-arranged and/or outwardly-angled so as to release diverging streams of aerosol.

In an example embodiment, at least one of a filter or a flavor medium may be optionally disposed within the mouthpiece 1104. In such an instance, a filter and/or a flavor medium will be downstream from a chamber 1305 of the capsule 100 such that the aerosol generated therein passes through at least one of the filter or the flavor medium before exiting through the at least one aerosol outlet 1102. The filter may reduce or prevent particles from the aerosol-forming substrate (e.g., from being inadvertently drawn from the capsule 100). The filter may also help reduce the temperature of the aerosol in order to provide a desired mouth feel. The flavor medium (e.g., flavor beads) may release a flavorant when the aerosol passes therethrough so as to impart the aerosol with a desired flavor. The flavorant may be the same as described above in connection with the aerosol-forming substrate. Furthermore, the filter and/or the flavor medium may have a consolidated form or a loose form as described supra in connection with the aerosol-forming substrate.

A first annular member 150 *a* (e.g., resilient O-ring) is upstream of the capsule 100 and prevents air from flowing through a holder 1307 for the heater 1300 and establishes an air seal between the heater 1300 and the capsule when the capsule 100 is fully inserted into the heating module 1203. The aerosol-generating device 10 may also include a second annular member 150*b* (e.g., resilient O-ring) seated within the receptacle 1228. As a result, most if not all of the air drawn into the heating module 1203 will pass through an annular portion of the capsule 100. In an example embodiment, the first annular member 150 *a* and the second annular member 150*b* may be formed of clear silicone.

The power supply 1234 may be a 900 mAh battery, although example embodiments are not limited thereto. In view of the sensor 1231 as well as the first button 1218 and the second button 1220, the operation of the aerosol-generating device 10 may be an automatic operation (e.g., puff-activated) or a manual operation (e.g., button-activated). In at least one example embodiment, the sensor 1231 may be a microelectromechanical system (MEMS) flow or pressure sensor or another type of sensor configured to measure air flow such as a hot-wire anemometer.

Upon activating the aerosol-generating device 10, the capsule 100 within the device body 1200 may be heated to generate an aerosol. In an example embodiment, the activation of the aerosol-generating device 10 may be triggered by the detection of an air flow by the sensor 1231 and/or the generation of a signal associated with the pressing of the first button 1218 and/or the second button 1220. With regard to the detection of an air flow, a draw or application of negative pressure on the aerosol outlet 1102 of the mouthpiece 1104 will pull ambient air into the device body 1200 via the inlet channel 1230, wherein the air may initially pass through the inlet insert 1222. Once inside the device body 1200, the air travels through the inlet channel 1230 and is detected by the sensor 1231. After the sensor 1231, the air continues through the receptacle 1228 and enters the capsule 100 in areas around the heater 1300. Specifically, the air will flow through the apertures of the capsule 100. Moreover, the control circuitry (e.g., the controller 2105) may supply an electric current from the power supply 1234 to the heater 1300 to maintain a temperature of the capsule 100 between draws.

The detection of the air flow by the sensor 1231 may cause the control circuitry to supply an electric current to the heater 1300 via the electric connection 1236*a*. As a result, the temperature of the heater 1300 will increase which, in turn, will cause the temperature of the capsule 100 to increase through heat transfer and causes the temperature of the aerosol-forming substrate inside the chamber of the capsule 100 to increase such that volatiles are released by the aerosol-forming substrate to produce an aerosol. The aerosol produced will be entrained by the air flowing through the chamber. In particular, the aerosol produced in the chamber will exit the aerosol-generating device 10 from the aerosol outlet 1102 of the mouthpiece 1104.

Figure 2C:
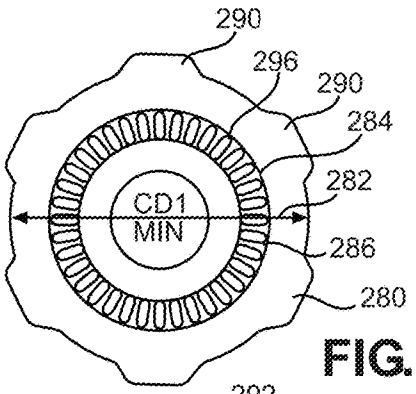
FIGS. 2A-2C illustrate a capsule according to at least one example embodiment.
Figure 2B:
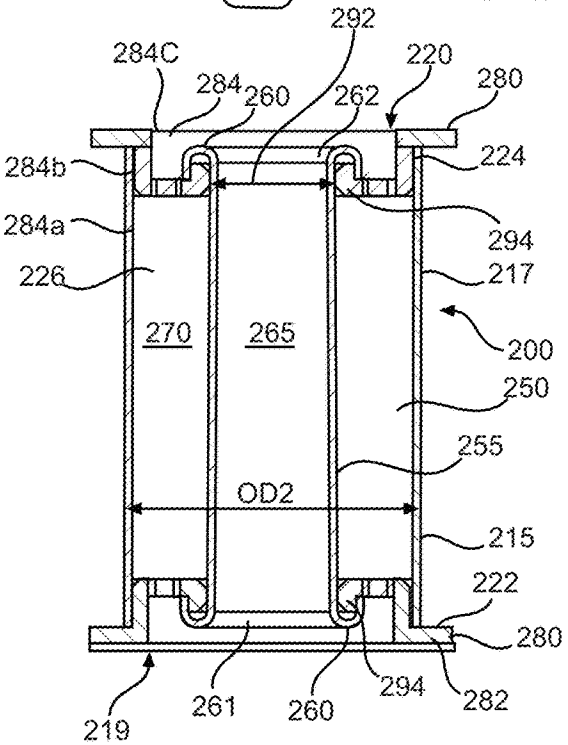
Figure 2A:
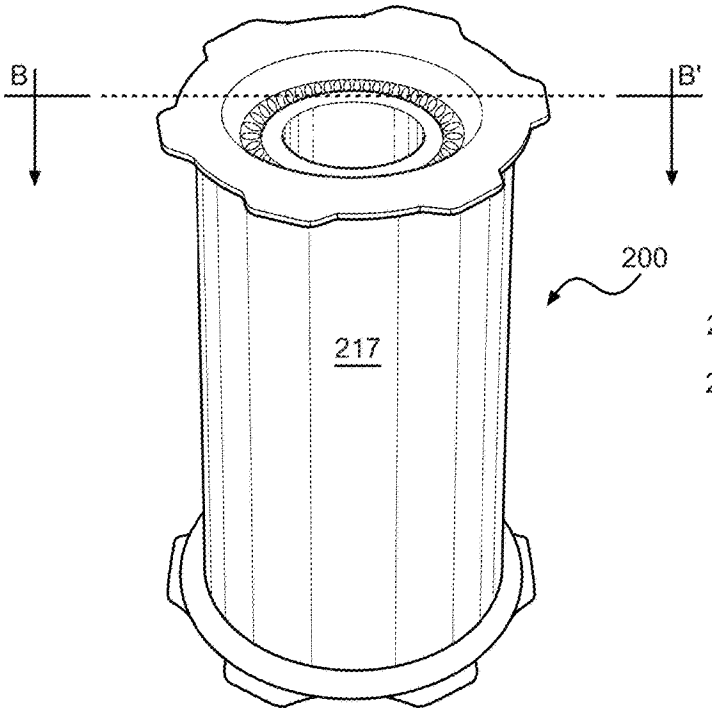

FIGS. 2A-2C illustrate a capsule according to at least one example embodiment. More specifically, FIG. 2A illustrates a perspective view of a capsule 200, FIG. 2B illustrates a cross-sectional view of the capsule 200 along the line B-B', and FIG. 2C illustrates a top view of the capsule 200.

As shown in FIG. 2B, the capsule 200 includes an outer body 215, an inner body 250 and end caps 280 *a*, 280*b*.

The outer body 215 may be cylindrical having a single wall 217 and may also be referred to as an outer tube. While some example embodiments are described with the outer body 215 being cylindrical, example embodiments are not limited thereto and the outer body 215 may be rectangular or another shape having an interior space.

The wall 217 defines openings 219, 220 at ends 222, 224, respectively, of the outer body 215. The ends 222 and 224 are opposing ends of the outer body 215. The wall 217 further defines an inner space 226 within the outer body 215 that extends from one end 222 to the end 224. In some example embodiments, the outer body 215 may include aluminum, paperboard, pulp, a plastic, a combination thereof or a sub combination thereof.

In some example embodiments, a thickness of the wall 217 is 100-200 μm when the wall 217 is metal. In example embodiments where the outer body 215 is plastic or a paper based material (e.g., pulp or paperboard), a thickness of the outer body may be 800-1500 μm. A wall 255 (described later) may have a same thickness as the wall 217. The capsule 200 may have a height (or length) of about 15 mm-20 mm (e.g., 16.3 mm), although example embodiments are not limited thereto.

End caps 280 are at openings 219, 220, respectively.

As shown in FIGS. 2A-2C, the end cap 280 includes a first circular portion 282, an inner wall 284 and a second circular portion 286.

The first circular portion 282 has a minimum outer diameter OD1_MIN larger than an outer diameter OD2 of the outer body 215 such that a portion of the first circular portion 282 may overlap the respective end 222, 224 of the outer body 215. A maximum diameter of the first circular portion may be about 10-11 mm (e.g., 10.6 mm).

A first surface 284*a* of the inner wall 284 defines the inner diameter and inner circumference of the first circular portion 282. The inner wall 284 extends from the first circular portion 282 to the second circular portion 286 such that the first circular portion 282 and the second circular portion 286 are on different planes, but parallel. In the example shown in FIG. 2B, the inner wall 284 is normal to the first circular portion 282 and the second circular portion 286. However, example embodiments are not limited thereto and the inner wall may extend at any angle from the first circular portion 282 to the second circular portion 286.

An outer diameter of the inner wall 284 and an outer diameter of the second circular portion 286 are such that the second circular portion 286 can be inserted into the outer body as a friction fit. Thus, the end cap 280 may be a compressible material and the outer diameter of the second circular portion 286 may be larger than the inner diameter of the outer body 215 before the second circular portion 286 of the end cap 280 is inserted into the outer body 215.

The end cap 280 may be made of a thermally insulating material such as a plastic, paperboard, pulp, a combination thereof or a sub combination thereof. The end cap 280 reduces energy transfer to the outer body 215 from the inner body 250 and provides a temperature gradient in the aerosol-forming substrate.

The second circular portion 286 defines a concentric opening 292 through the second circular portion 286. More specifically, the second circular portion 286 includes a circular cold rolled edge 294 that defines the concentric opening 292. In the example shown in FIG. 2B, the concentric opening 292 is circular, but may be a polygonal shape such as a square or triangle.

The second circular portion further includes a plurality of apertures 296.

The plurality of apertures 296 are arranged in a circular manner within the second circular portion 286 such that the plurality of apertures 296 form a circle that is concentric with the concentric opening 292. The apertures 296 extend through the end cap 280 and may be equidistant apart. However, example embodiments are not limited thereto. The number of apertures 296 may be based on a computational fluid dynamics analysis.

The apertures 296 allow air to enter the capsule 200. More specifically, air enters through the apertures 296, flows into the inner space 226 and out of apertures 296 in the opposing end cap.

The apertures 296 are sized such that the aerosol-forming substrate do not fall out of the apertures and may not be pulled out of the capsule. In some example embodiments, a width of the apertures 296 is 0.3 mm. In other example embodiments, the diameter of the apertures 296 may be larger or smaller depending on the particle size of the aerosol-forming substrate inside the capsule 200. In some example embodiments where the aperture is not circular, the apertures may have a length of 2 mm and/or equal to a thickness of an aerosol-generating substrate bed (e.g., bed of tobacco). As will be described in greater detail below, the shape of the aperture may vary based on desired air flow and temperature of aerosol exiting the capsule 200.

The inner body 250 extends within the outer body 215 along a longitudinal axis of the outer body 215.

The inner body 250 may be cylindrical having single wall 255 and may also be referred to as an inner tube. The inner body 250 may have a same length as the outer body 215, which may be 15 mm or about 15 mm. In other example embodiments, the length may be different and/or the inner body 250 and the outer body 215 may have different lengths.

Figure 2D:
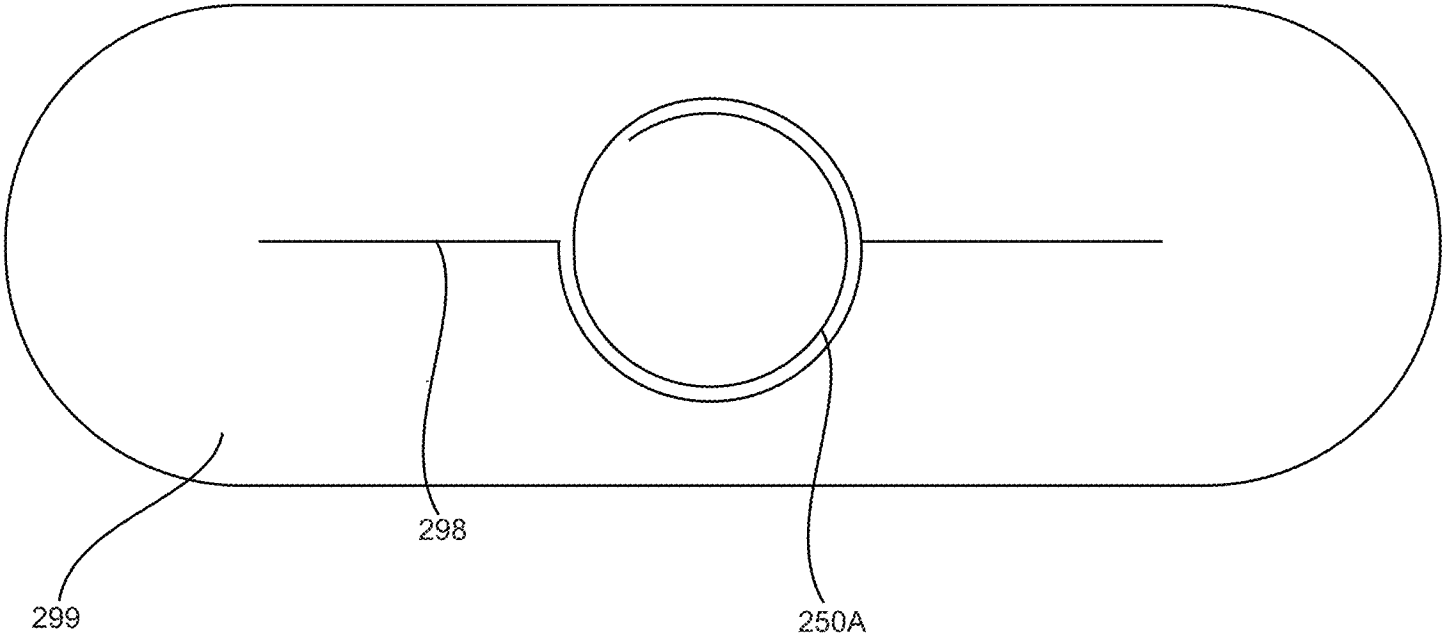
FIG. 2D illustrates an inner body of a capsule according to at least one example embodiment.

While some example embodiments are described with the inner body 250 being cylindrical, example embodiments are not limited thereto and the inner body 250 may be rectangular or another shape having an interior space. For example, an inner body 250 *a* may include fins 298 that extend into an aerosol-forming substrate 299, as shown in FIG. 2D. Moreover, as shown in FIG. 2D, the capsule is not limited to a cylindrical shape. For example, an outer body of the capsule may be shaped as described in U.S. application Ser. No. 17/151,340, the entire contents of which are hereby incorporated by reference.

The inner body 250 extends through the concentric opening 292 of one end cap 280 though the concentric opening 292 of the opposing end cap 280. The single wall 255 may also include rolled edges 260 that are rolled over cold rolled edges 294, respectively, to connect the inner body 250 to the end caps 280. In other example embodiments, the inner body 250 may be connected to the end caps 280 by a snap-fit connection, swaging, adhesive or friction fit connection, for example. In other example embodiments, the outer body 215 and the end caps 280 may be connected by welding the outer body 215 and the end caps 280 together.

The wall 255 may have a thickness to transfer sufficient heat to the aerosol-forming substrate, maintain a load created when a heater is inserted into the inner body 250 and deform to create a desired thermal contact with the heater. In some example embodiments, the thickness of the wall 255 may be 0.1 mm or about 0.1 mm.

An inner surface of the wall 255 defines openings 261, 262 to the inner body 250. The openings 261, 262 may be coplanar with the ends 222, 224, respectively, and/or vertices of the rolled edges 260. The ends 222 and 224 are opposing ends of the outer body 215. An inner surface of the wall 255 further defines an inner space 265 within the inner body 250 that extends from one vertex of a rolled edge 260 to a vertex of the opposing edge 260 (e.g., extending the length of the inner body 250 along the longitudinal axis of the inner body 250).

The wall 255, the wall 217 and end caps 280 define a cavity 270 for containing an aerosol-forming substrate. In an example embodiment, the cavity 270 is a volume between the wall 255, the wall 217 and the end caps 280. A length in the cavity 270 between the two end caps 280 may be 10-15 mm (e.g., 12.1 mm). It should be understood that the length between the two end caps 280 may be increased or decreased to vary a volume of a material in the cavity 270. Moreover, increasing the length between the two end caps 280 may increase the resistance to draw (RTD). In some example embodiments, a width of the cavity 270 (distance between the wall 255 and the wall 217) may be 2 mm. An inner diameter of the wall 255 that defines the space 265 may be 3-4 mm (e.g., 3.2 mm). In some example embodiments, the cavity may have a volume of about 450-500 $mm^3$ (e.g., 480 $mm^3$).

The cavity 270 may be annulus shaped with the wall 255 serving as an inner ring boundary and the wall 217 serving as an outer ring boundary. However, example embodiments are not limited thereto. The end caps 280 prevent the aerosol-forming substrate from exiting the space between the wall 255 and the wall 217.

The outer body 215 and the inner body 250 may be made of the same material or different materials. The outer body 215 and the inner body 250 may each include a suitable heat conducting material such as aluminum, an aluminum alloy, stainless steel, copper alloy or a combination thereof. In some example embodiments, the outer body 215 may be paperboard, pulp, a plastic, a combination thereof or a sub combination thereof.

The end caps 280 may be a heat conductive or non-heat conductive material. In some example embodiments, the end caps are a non-heat conductive material to increase energy delivered to a material (e.g., an aerosol-forming substrate) in the cavity 270.

As shown in FIG. 2C, the first circular portion 282 includes tabs 290 arranged at periodic intervals along the circumference of the first circular portion 282. However, example embodiments are not limited thereto and the first circular portion 282 may exclude the tabs 290. The tabs 290 minimize/reduce thermal exposure to an outer enclosure (e.g., a housing of an aerosol-generating device).

FIGS. 3A-3D illustrate a capsule and a heater according to at least some example embodiments.

Figure 3A:
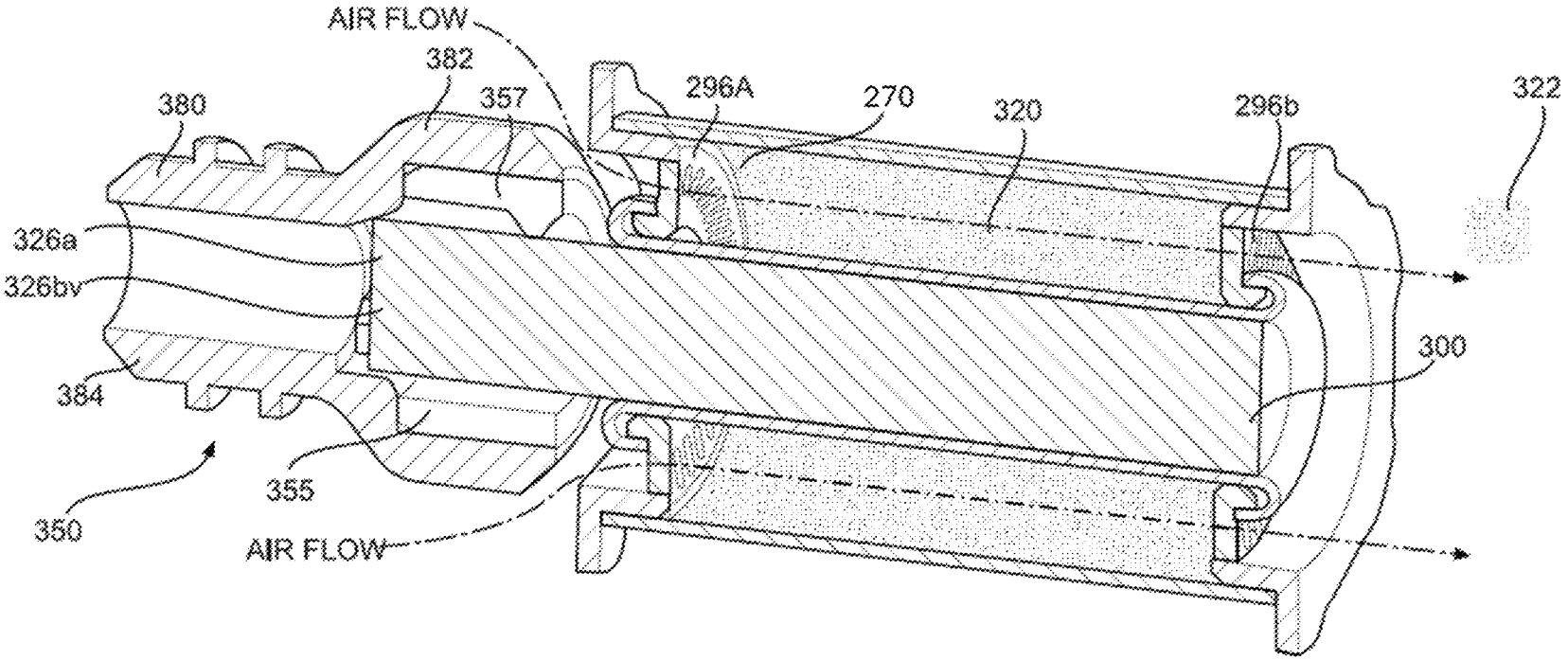
FIGS. 3A-3D illustrate a capsule and a heater according to at least some example embodiments.

As shown in FIG. 3A, a heater 300 may be inserted into the space 265 of the inner body 250. The heater 300 may extend the entire length of the cavity 270. The heater 300 may be the heater 1300, described with reference to FIGS. 1F and 1G.

In an example embodiment, the heater 300 is in thermal communication with the capsule 200.

In an example embodiment, the heater 300 heats an aerosol-forming substrate 320 in the capsule 200 in order to produce an aerosol 322. In an example embodiment, at least a portion of the heater 300 contacts the capsule 200 such that heat generated by the heater 300 is transferred to the capsule 200. The capsule 200 is made of a heat conducting material and heats the aerosol-forming substrate 320 using the heat generated by the heater 300.

In some example embodiments, the heater 300 warms the inner body 250 and the inner body 250 transfers the heat from the heater 300 to the aerosol-forming substrate 320, but the heater 300 does not burn and/or combust the aerosol-forming substrate 320. In some example embodiments, the heater 300 includes a sleeve to act as a shim and increase contact with the capsule 200. Additionally or alternatively, the inner body 250 is designed to increase contact and thermal transfer between the heater 300 and the capsule 200.

The heater 300 may heat the aerosol-forming substrate 320 to a temperature of 125 degrees Celsius to 320 degrees Celsius and, more preferable, between 250-280 degrees Celsius. However, example embodiments are not limited thereto. For example, the heater 300 may be controlled to heat at a desired temperature based on a type of aerosol-forming substrate 320 in the capsule 200, the density of the aerosol-forming substrate in the capsule 200, additives in the aerosol-forming substrate, a sub-combination thereof or a combination thereof. Moreover, the heater 300 may be controlled using a proportional-integral-derivative controller to use multiple temperature setpoints to normalize aerosol generation.

Air flows along path 330 and enters the capsule 200 through apertures 296*a*. The heater 300 is capable of heating the aerosol-forming substrate 320 to an extent that the flavoring, nicotine and/or ingredients in the aerosol-forming substrate 320 is at least partially extracted (e.g., aerosolized) to create the aerosol 322 that is extracted from aerosol-forming substrate 320. The heater 300 heats the capsule 200 and the aerosol-forming substrate 320 to an extent that the aerosol-forming substrate 320 and the flavoring, nicotine and/or other materials of the aerosol-forming substrate 320 remain below a combustion temperature.

Consequently, the air mixes with the aerosol-forming substrate 320 to form an aerosol 322 that exists the capsule 200 through apertures 296*b*.

As discussed herein, an aerosol-forming substrate is a material or combination of materials that may yield an aerosol. An aerosol relates to the matter generated or output by the devices disclosed, claimed, and equivalents thereof. The material may include a compound (e.g., nicotine, cannabinoid, cannabimimetic agent) that is released when the material is heated. In such an instance, an aerosol including the compound is produced when the material is heated. The heating may be below the ignition temperature so as to avoid a self-sustaining burning or a self-sustaining combustion of the material (i.e., in contrast to where a material is lit, such as lit-end cigarettes). It is understood that heating of a material below its ignition temperature may, in some circumstances, produce incidental and insubstantial levels of oxidized or other thermal decomposition byproducts. However, in some embodiments, the heating in aerosol-generating devices is below the pyrolysis temperature of the material so as to produce an aerosol having no or insubstantial levels of thermal decomposition byproducts of the material. Thus, in an example embodiment, pyrolysis of the material does not occur during the heating and resulting production of aerosol. In other instances, there may be incidental pyrolysis, with production of oxidized or other thermal decomposition byproducts at levels that are insignificant relative to the primary constituents released by heating of the material.

The material(s) of the aerosol-forming substrate may include a fibrous material. For instance, the fibrous material may be a botanical material. The fibrous material is configured to release a compound when heated. The compound may be a naturally occurring constituent of the fibrous material. For instance, the fibrous material may be plant material such as tobacco, and the compound released may be nicotine. The term "tobacco" includes any tobacco plant material including tobacco leaf, tobacco plug, reconstituted tobacco, compressed tobacco, shaped tobacco, or powder tobacco, and combinations thereof from one or more species of tobacco plants, such as *Nicotiana rustica* and *Nicotiana tabacum*.

In some example embodiments, the tobacco material may include material from any member of the genus *Nicotiana*. In addition, the tobacco material may include a blend of two or more different tobacco varieties. Examples of suitable types of tobacco materials that may be used include, but are not limited to, flue-cured tobacco, Burley tobacco, Dark tobacco, Maryland tobacco, Oriental tobacco, rare tobacco, specialty tobacco, blends thereof, and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. In some example embodiments, the tobacco material is in the form of a substantially dry tobacco mass. Furthermore, in some instances, the tobacco material may be mixed and/or combined with at least one of propylene glycol, glycerin, sub-combinations thereof, or combinations thereof.

The compound in the generated aerosol may also be a naturally occurring constituent of a medicinal plant that has a medically-accepted physiological effect (e.g., therapeutic effect, prophylactic effect). For instance, the medicinal plant may be a cannabis plant or a cannabimimetic plant (i.e., a plant with similar pharmacological effects to those of cannabis). For a cannabis plant, the compound may be a cannabinoid. Cannabinoids interact with receptors in the body to produce a wide range of effects. As a result, cannabinoids have been used for a variety of medicinal purposes (e.g., treatment of pain, nausea, epilepsy, psychiatric disorders). The fibrous material may include the leaf and/or flower material from one or more species of cannabis plants such as *Cannabis sativa, Cannabis indica*, and *Cannabis ruderalis*. In some instances, the fibrous material is a mixture of 60-80% (e.g., 70%) *Cannabis sativa* and 20-40% (e.g., 30%) *Cannabis indica*. For a cannabimimetic plant, the compound may be a cannabimimetic agent. Cannabimimetic agents interact with receptors in the body to produce similar pharmacological effects as cannabinoids.

Examples of cannabinoids include tetrahydrocannabinolic acid (THCA), tetrahydrocannabinol (THC), cannabidiolic acid (CBDA), cannabidiol (CBD), cannabinol (CBN), cannabicyclol (CBL), cannabichromene (CBC), and cannabigerol (CBG). Tetrahydrocannabinolic acid (THCA) is a precursor of tetrahydrocannabinol (THC), while cannabidiolic acid (CBDA) is precursor of cannabidiol (CBD). Tetrahydrocannabinolic acid (THCA) and cannabidiolic acid (CBDA) may be converted to tetrahydrocannabinol (THC) and cannabidiol (CBD), respectively, via heating. In an example embodiment, heat from a heater (e.g., of the heating assembly 340 shown in FIG. 8) may cause decarboxylation so as to convert the tetrahydrocannabinolic acid (THCA) to tetrahydrocannabinol (THC), and/or to convert the cannabidiolic acid (CBDA) to cannabidiol (CBD).

In instances where both tetrahydrocannabinolic acid (THCA) and tetrahydrocannabinol (THC) are present, the decarboxylation and resulting conversion will cause a decrease in tetrahydrocannabinolic acid (THCA) and an increase in tetrahydrocannabinol (THC). At least 50% (e.g., at least 87%) of the tetrahydrocannabinolic acid (THCA) may be converted to tetrahydrocannabinol (THC) during the heating. Similarly, in instances where both cannabidiolic acid (CBDA) and cannabidiol (CBD) are present, the decarboxylation and resulting conversion will cause a decrease in cannabidiolic acid (CBDA) and an increase in cannabidiol (CBD). At least 50% (e.g., at least 87%) of the cannabidiolic acid (CBDA) may be converted to cannabidiol (CBD) during the heating.

Furthermore, the compound which is released may be or may additionally include a non-naturally occurring additive that is subsequently introduced into the fibrous material. In one instance, the fibrous material may include at least one of cotton, polyethylene, polyester, rayon, combinations thereof, or the like (e.g., in a form of a gauze). In another instance, the fibrous material may be a cellulose material (e.g., non-tobacco and/or non-cannabis material). In either instance, the compound introduced may include nicotine, cannabinoids, cannabimimetic agents, and/or flavorants. The flavorants may be from natural sources, such as plant extracts (e.g., tobacco extract, cannabis extract, cannabimimetic extract), and/or artificial sources. In yet another instance, when the fibrous material includes tobacco and/or cannabis, the compound may be or may additionally include one or more flavorants (e.g., menthol, mint, vanilla). Thus, the compound within the aerosol-forming substrate may include naturally occurring constituents and/or non-naturally occurring additives. In this regard, it should be understood that existing levels of the naturally occurring constituents of the aerosol-forming substrate may be increased through supplementation. For example, the existing levels of nicotine in a quantity of tobacco may be increased through supplementation with an extract containing nicotine. Similarly, the existing levels of one or more cannabinoids in a quantity of cannabis may be increased through supplementation with an extract containing such cannabinoids. Likewise, the existing levels of one or more cannabimimetic agents in a quantity of cannabimimetic material may be increased through supplementation with an extract containing such cannabimimetic agents.

In at least some example embodiments, the cavity 270 may contain 180-320 mg of tobacco.

The heater 300 is cylindrically shaped. In at least some example embodiments, the heater 300 is shaped to fit in the space 265 and to contact the wall 255.

The heater 300 may be a ceramic cartridge heater that heats the capsule 200 through conduction. In other example embodiments, the heater 300 may include a heating coil wrapped around a ceramic mandrel.

In some example embodiments, the heater 300 may be a machined heater including a central spine formed from a high temperature material (e.g., ceramic) and a resistive heating coil wound around the spine. The resistive heating coil is configured to heat the spine, which results in heating the capsule.

In other example embodiments, the heater 300 may be a filament heater which includes a glass tube covering a wound wire resistive heating coil. The heating coil is in thermal contact with an inner surface of the tube and an outer surface is in direct thermal contact with the capsule. In other example embodiments, the filament heater may include a stamped or printed heater on a flexible substrate instead of the resistive coil. The heater may be rolled and placed within the glass tube (or alternatively and thin stainless tube).

The heater may be cylindrically shaped and connected to wires 326*a* and 326*b* to receive power from a power source via a controller (e.g., the controller 2105). The wires 326*a* and 326*b* may be the electric connection 1236*a* shown in FIGS. 1F-1G.

The heater 300 is configured to heat the aerosol-forming substrate. As a result of the heating, the temperature of the aerosol-forming substrate may increase, and an aerosol may be generated.

In an example embodiment, the heater 300 is configured to undergo Joule heating (which is also known as ohmic/resistive heating) upon the application of an electric current thereto. Stated in more detail, the heater 300 may be formed of conductors (same or different) and configured to produce heat when an electric current passes through the conductors. The electric current may be supplied from the power source. Suitable conductors for the heater 300 include an iron-based alloy (e.g., stainless steel) and/or a nickel-based alloy (e.g., nichrome). The resistance of the heater 300 may be 1 ohm and the diameter of the heater 400 is about 2 mm with a length of about 15 mm. Furthermore, although the heaters are shown in FIGS. 3A-3D as cylindrical, it should be understood that, in some example embodiments, the heater may be a different shape.

The electric current from the power source may be transmitted via electrodes/wires 326*a* and 326*b* connected to the heater 300. Furthermore, the supply of the electric current to the heater 300 may be a manual operation (e.g., button-activated) or an automatic operation (e.g., puff-activated).

A mount 350 holds the heater 300. The mount 350 includes an inner annular portion 355 and an outer portion 380. The inner annular portion 355 first within a first portion 382 of the outer portion 380. The inner annular portion 355 includes a plurality of protrusions 357 that protrude into an inner space of the inner annular portion 355. The plurality of protrusions 357 form a connection interface with the heater 300. The plurality of protrusions 357 contact the heater 300 and provide sufficient friction with the heater 300 to prevent the heater 300 from being separated from the mount 350 when the capsule 200 is pulled off of the heater 300.

The plurality of protrusion 357 reduce the amount of contact between the mount 350 and the heater 300.

A second portion 384 of the outer portion has a smaller internal diameter than the first portion 382. The electrodes/wires 326*a* and 326*b* extend through the second portion 384 to couple to the heater 300.

The mount 350 may be a high temperature plastic such as liquid-crystal polymer (LCP), polyetheretherketone (PEEK) and/or a high temperature ceramic (e.g., relatively high temperature rating and relatively low thermal conductivity). The inner annular portion 355 and an outer portion 380 may be the same material to match thermal expansion.

Figure 3B:
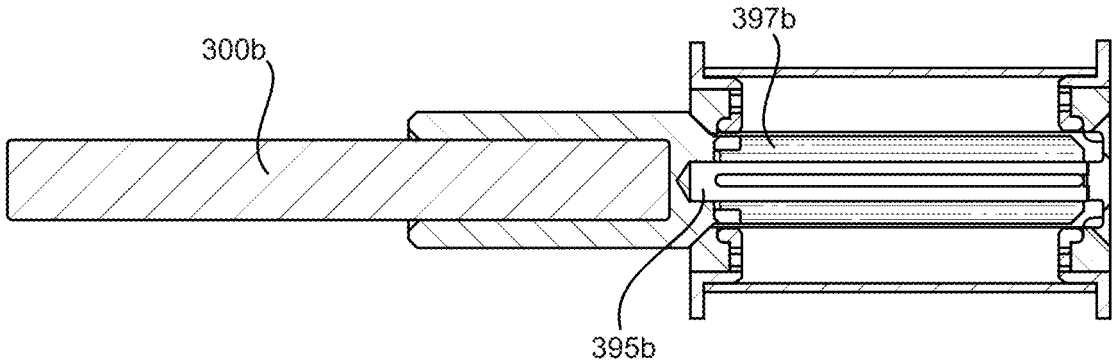
Figure 3C:
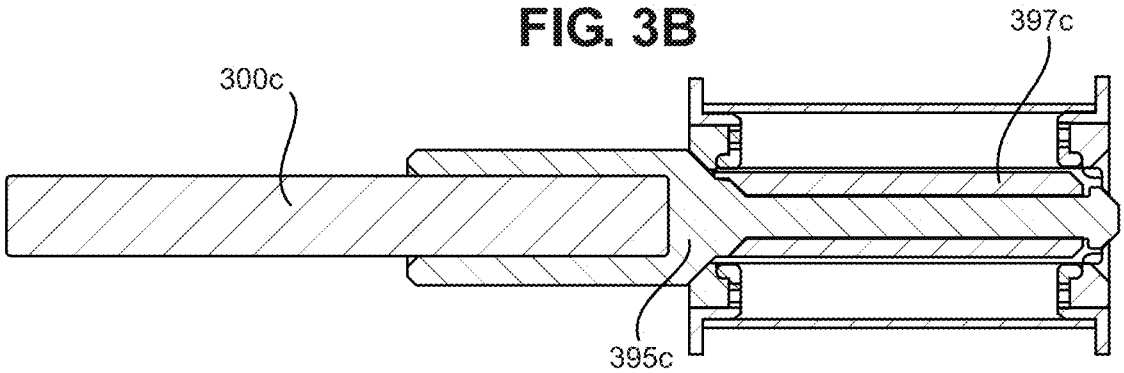

FIGS. 3B-3C illustrate example embodiments of a heater including a sleeve.

As shown in FIG. 3B, a heater 300*b* includes a heat generating post 395*b* and fins 397*b* extend around the heat generating post 395*b*. When the heater 300*b* is inserted into the inner body 250, the fins 397*b* contact the wall 255 and compresses towards the heat generating post 395*b*. The fins 397*b* transfer heat from the heat generating post 395*b* to the wall 255 of the inner body 20.

As shown in FIG. 3C, a heater 300*c* includes a heat generating post 395*c* and a c-shaped sleeve 397*c* around the heat generating post 395*c*. When the heater 300*c* is inserted into the inner body 250, the c-shaped sleeve 397*c* contacts the inner body 250 and compresses towards the heat generating post 395*c*. The c-shaped sleeve 397*c* transfers heat from the heat generating post 395*b* to the wall 255 of the inner body 250.

Figure 3D:
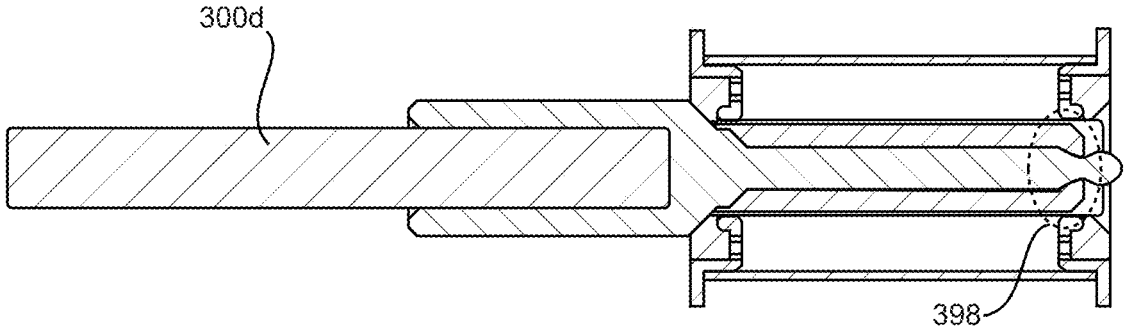

A heater 300*d*, shown in FIG. 3D, is the same as the heater 300*c* except the c-shaped sleeve and the heat generating post are angled (as shown in area 398) to increase contact between the heat generating post and the c-shaped sleeve.

Figure 4B:
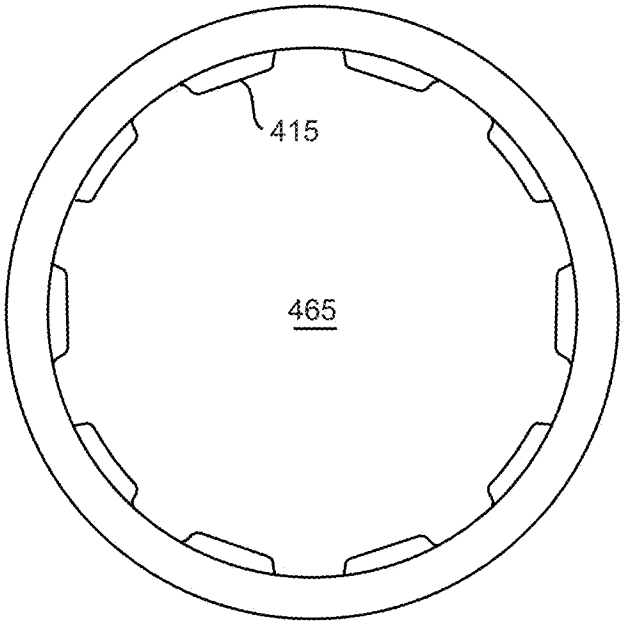
FIG. 4B illustrates a side view of the inner body of FIG. 4A.
Figure 4A:
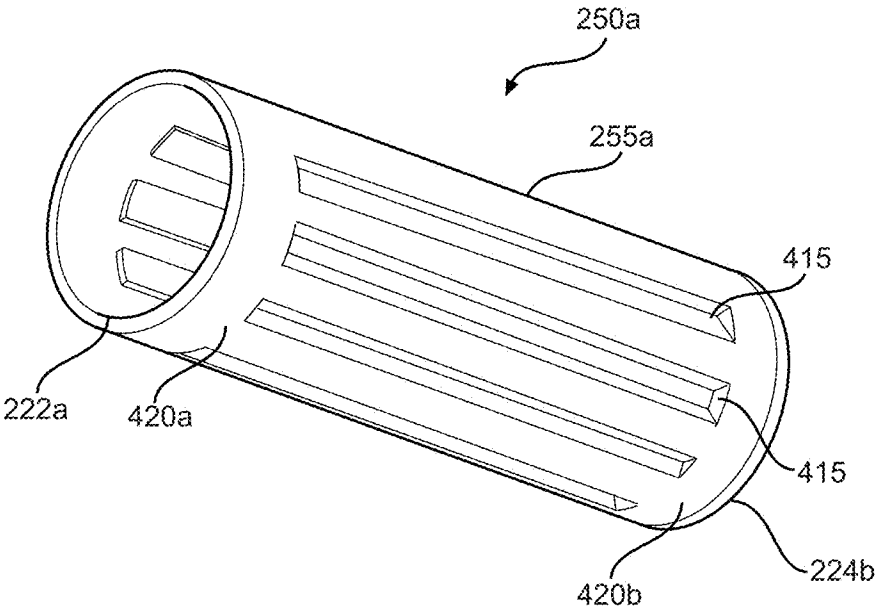
FIG. 4A illustrates a perspective view of an inner body of a capsule according to at least one example embodiment.

FIG. 4A illustrates a perspective view of an inner body of a capsule according to at least one example embodiment and FIG. 4B illustrates a side view of the inner body of FIG. 4A.

FIGS. 4A-4B illustrate an inner body 250 *a* according to at least one example embodiment. The inner body 250 *a* is similar to the inner body 250 and the inner body 250 *a* may be used in the capsule 200. Thus, for the sake of brevity, differences between the inner body 250 *a* and the inner body 250 are discussed.

The inner body 250 *a* includes a wall 255*a*. The wall 255*a* defines an internal space 465 of the inner body 250 *a*. The wall 255 includes a plurality of ribs 415 that form depressions on an outer surface of the wall 255*a* and protrude into the internal space 465. The ribs 415 are rectangular shaped. Because the ribs 415 protrude into the inner space 265, the ribs 415 permit direct thermal contact between the inner body 250 *a* and the heater 300.

The ribs 415 extend in the direction of the longitudinal axis of the inner body 250 *a*. In the example shown in FIG. 4A, the wall 255*a* includes flat portions 420 *a* and 420*b* at opposing ends 222*a* and 224*a*, respectively. The flat portions 420 *a* and 420*b* are flat surfaces of the wall 255*a* around the circumference of the wall 255*a* for a selected length. The ribs 415 extend between the flat portions 420 *a* and 420*b*. The ribs 415 may act as shims between the wall 255*a* and a heater.

In another example embodiment, the ribs 415 may extend the entire length of the inner body 250 *a*.

The ribs 415 are semi-flexible and compress upon a heater being inserted into the inner body 250 to create a friction fit and permit direct contact with the ribs 415 and the heater. The heater may contact the ribs 415 along the entire length of the ribs. As shown in FIG. 4B, the ribs 415 have a rectangular cross section.

Figure 5B:
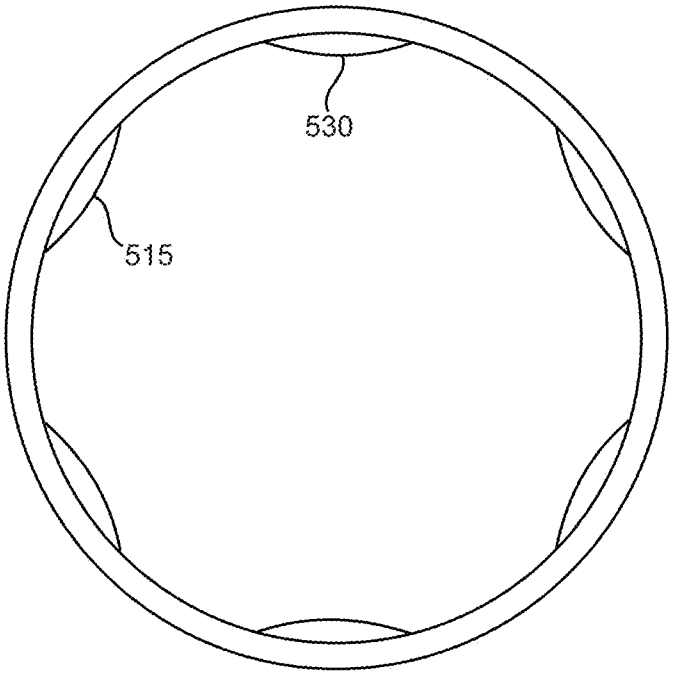
FIG. 5B illustrates a side view of the inner body of FIG. 5A.
Figure 5A:
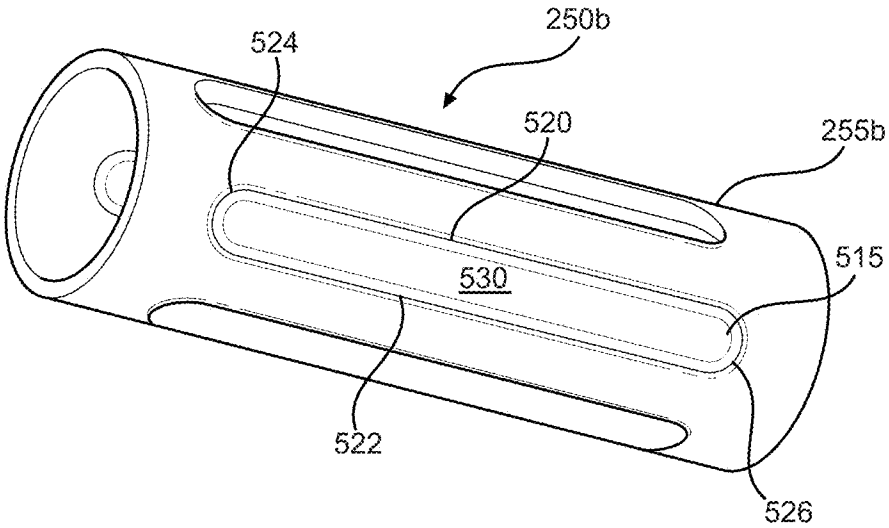
FIG. 5A illustrates a perspective view of an inner body of a capsule according to at least another example embodiment.

FIG. 5A illustrates a perspective view of an inner body of a capsule according to at least one example embodiment and FIG. 5B illustrates a side view of the inner body of FIG. 5A.

FIGS. 5A-5B illustrate an inner body 250*b* according to at least one example embodiment. The inner body 250*b* is similar to the inner body 250 *a* and the inner body 250*b* may be used in the capsule 200. Thus, for the sake of brevity, differences between the inner body 250*b* and the inner body 250 *a* are discussed.

The inner body 250*b* is the same as the inner body 250 except the inner body 250*b* includes a plurality of ribs 515 that are curved, instead of rectangular. More specifically, each rib 515 includes a first straight side 520 and a second straight side 522. A rounded side 524 connects the first straight side 520 and the second straight side 522 at a first end and a rounded side 526 connects the first straight side 520 and the second straight side 522 at a second end. The first straight side 520, the second straight side 522, the rounded side 524 and the rounded side 526 define edges of a concave surface 530.

In the example embodiments shown in FIGS. 4A-4B and 5A-5B, the ribs 415 and 515 are formed after the cylindrical body of the inner body is formed. For example, a sheet of aluminum is rolled into a cylindrical shape and the ribs are then formed by pressing the tube. In embodiments where the sheet is longer than the inner body, the sheet is cut after the ribs are formed, thereby generating a plurality of inner bodies.

The thickness of the ribs and the number of ribs may be determined based on empirical data or using Finite Element Analysis (FEA). The thickness of the ribs is also based on a tolerance of the width of the heater and the ability to maintain a flexibility while maintaining the ability to provide desired thermal contact with the heater.

Figure 6B:
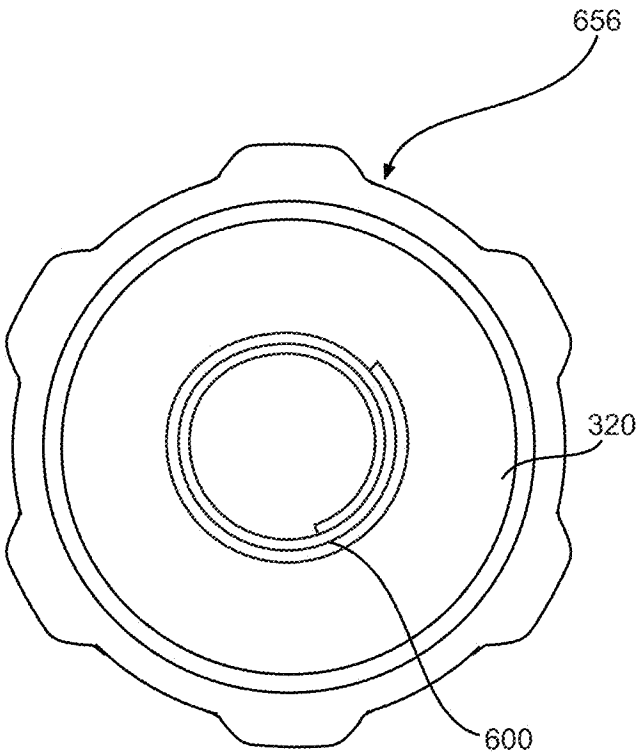
FIGS. 6A-6B illustrate an inner body of a capsule according to at least one example embodiment.
Figure 6A:
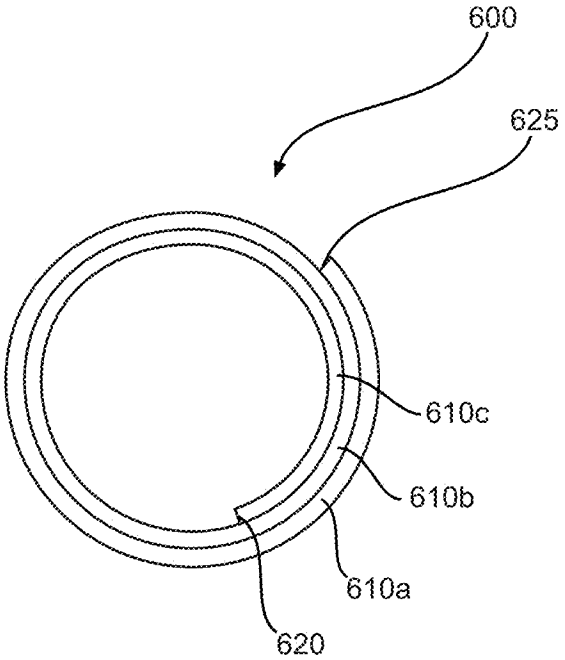

FIGS. 6A-6B illustrate an inner body according to at least one example embodiment.

FIG. 6A illustrates a top view of an inner body 600. The dimensions and material of the inner body 600 may be the same as the inner body 250.

The inner body 600 is the same as the inner body 250 except the inner body 600 includes a rolled sheet that forms a plurality of layers 610 *a*, 610*b* and 610*c* in a coiled fashion to create a spring biased in the position shown in FIG. 6A. More specifically, the sheet is rolled from a first tongue 620 (inner most part of the inner body 600) to a second tongue 625 (outer most part of the inner body 600). The layers 610 *a*, 610*b* and 610*c* are overlapping.

The coiling creates overlaps, and so wall thickness is not constant. The inner diameter of the coiled body is set to be less than the outer diameter of the heater, ensuring that the coiled body flexes outwards in order to be placed over the heater. In an example embodiment, the inner diameter of the coiled body may therefore be set to be 2.9 mm for use with a heater that has an outer diameter of 3.2 mm (i.e. ensuring contact under all manufacturing tolerances).

The outer diameter inner body 600 is based on the thickness of the sheet (e.g., 50 μm, 100 μm or 150 μm and the number of wraps, e.g., 2 or 3). The number of wraps is a way of controlling the spring force and strength. In an example embodiment, for a 100 μm sheet and 2 full wraps (i.e., 2 or 3 layers of thickness) the outer diameter of the coiled body may be 3.1 to 3.2 mm (i.e., 2.9+2*0.1 to 2.9+3*0.1).

The internal diameter of the inner body 600 is smaller than the diameter of the heater 300. Thus, when the heater 300 is inserted though the inner body 600 or the inner body 600 is placed over the heater 300, the rolled sheet expands/partially unwraps causing the inner diameter of the inner body 600 to expand to a diameter larger than the diameter of the heater 300. Due to the coiling and spring bias of the inner body, the thermal conductivity between the inner body 600 on the heater 300 is increased.

Due to the coiling and spring bias of the inner body 600, the proportion of the inner body in direct thermal contact with the heater 300 is increased when the inner body 600 is inserted on the heater 300, and therefore thermal conductivity between the inner body 600 and the heater is improved.

While the number of layers is three, it should be understood that the number of layers may be higher or lower and the thickness of the layers maybe higher or lower.

To make the inner body 600, a central mandrel may be used in a rolling operation to provide the desired curvature of the first tongue 620 of the sheet.

FIG. 6B illustrates a cross-section view of the inner body 600 in a capsule 650. The capsule 650 is the same as the capsule 200 except the capsule 650 includes the inner body 600.

Figure 7A:
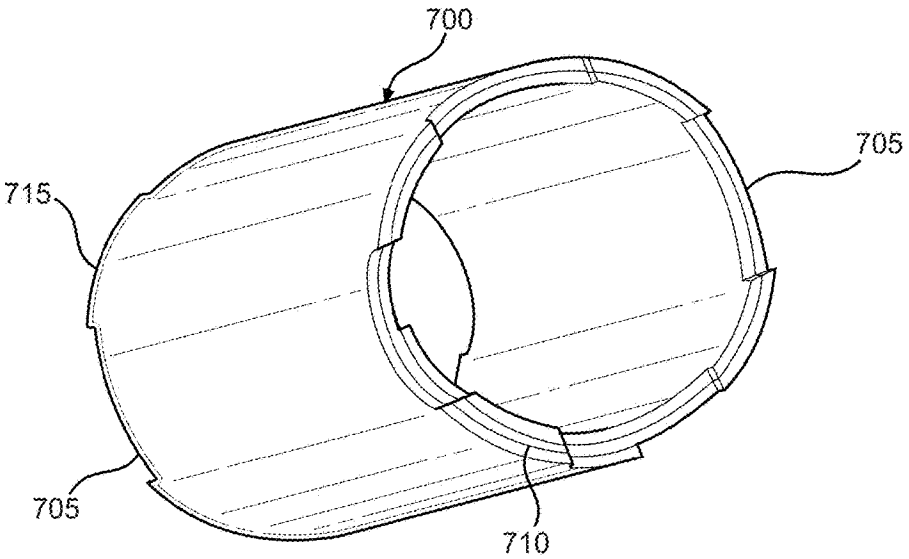
FIGS. 7A-7C illustrate an inner body of a capsule according to at least one example embodiment.
Figure 7B:
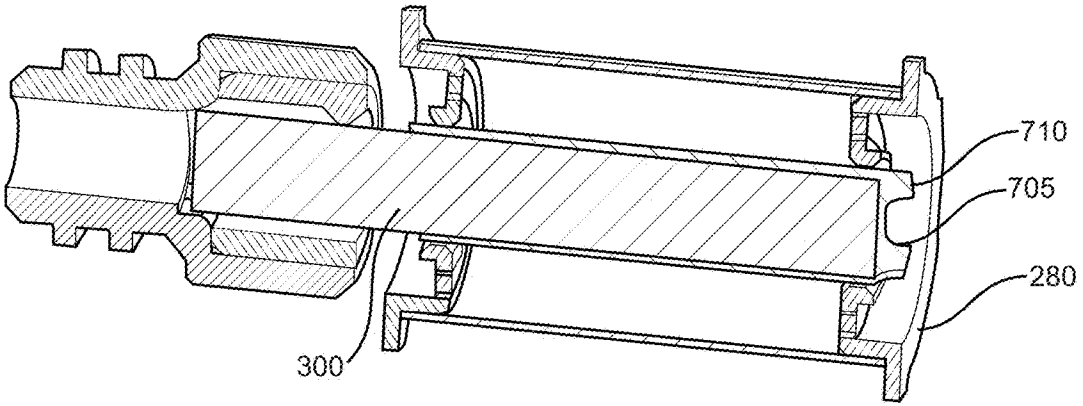
Figure 7C:
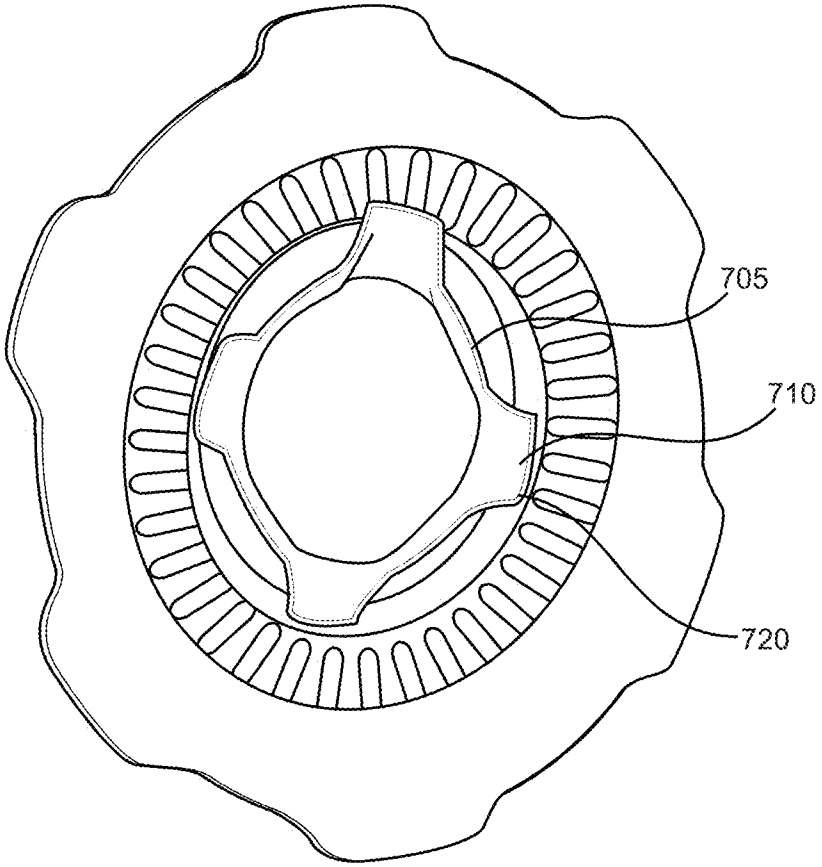

FIGS. 7A-7C illustrate an inner body according to at least one example embodiment.

FIG. 7A illustrates an inner body 700 according to an example embodiment. The inner body 700 is the same as the inner body 600 except the inner body 700 includes a plurality of grooves 705 at ends 710 and 715 of the body 700. The grooves 705 may be U-shaped, but are not limited thereto. The grooves may be any other shape that permit the ends 710, 715 to be rolled/swaged over the ends caps 280.

FIG. 7B illustrates a heater inserted in the inner body 700. The arrangement in FIG. 7B is the same as the arrangement shown in FIG. 3A except the inner body 700 is included and the ends 710, 715 are not rolled/swaged.

As shown in FIG. 7C, the grooves 705 become stretched as the end 710 is rolled/swaged onto the end cap 280 to create tabs 720.

Figure 8A:
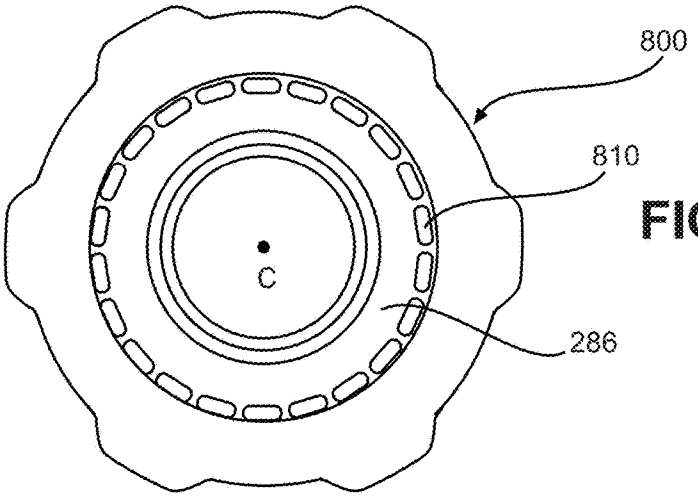
FIG. 8A illustrates an end cap according to at least one example embodiment.
Figure 8B:
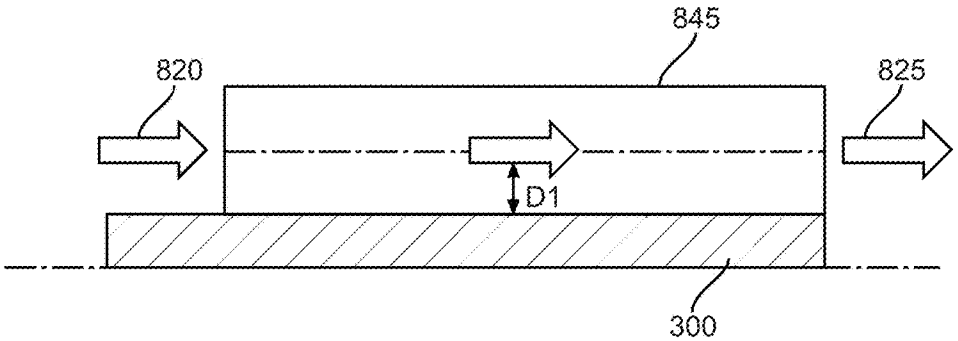
FIG. 8B illustrates an airflow pattern of an inner body using the end cap of FIGS. 2A-3A.

FIG. 8A illustrates an end cap according to at least one example embodiment. FIG. 8B illustrates an airflow pattern of an inner body using the end cap of FIGS. 2A-3A and FIG. 8C illustrates an airflow pattern of an inner body using the end cap shown in FIG. 8A.

As shown in FIG. 8A, an end cap 800 includes a plurality of apertures 810 arranged in a circular pattern. The end cap 800 is the same as the end cap 280 except for the apertures.

Thus, for the same of brevity, only the differences will be described. As shown in FIG. 2C, a length of the apertures 296 of the end cap 280 extend in a direction normal to a circumferential axis of the second circular portion 286. By contrast, in FIG. 8A, a length of the apertures 810 extends along and/or in parallel to the circumferential axis of the second circular portion 286. While twenty-two apertures are shown, it should be understood that the end cap 800 may include more or less than twenty-two apertures. In the example shown in FIG. 8A, the apertures 810 are located at the outer most edge of the second circular portion 286 (i.e. at a length equal to the radius from a center C of the second circular portion 286).

While FIG. 8A illustrates the apertures 810 are at an outer most edge of the second circular portion 286, it should be understood that the apertures 810 may be closer to the center C and may be arranged in a non-circular pattern.

Figure 8C:
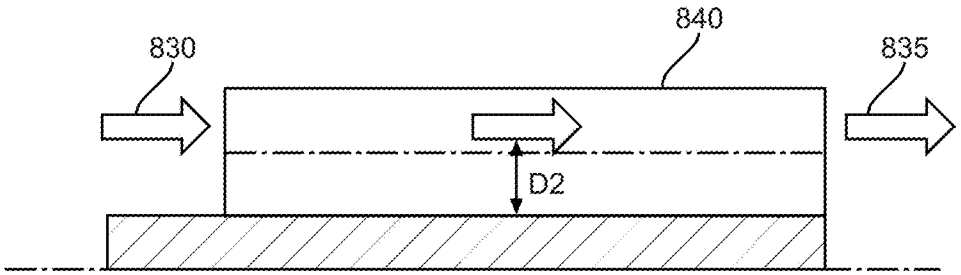
FIG. 8C illustrates an airflow pattern of an inner body using the end cap shown in FIG. 8A.

The apertures 810 may be arranged to generate a desired air flow pattern and temperature. For example, FIG. 8B illustrates an airflow pattern of an inner body using the end cap 280 and FIG. 8C illustrates an airflow pattern of an inner body using the end cap 800 (shown in FIG. 8A). For simplicity, the elements of the capsule are not shown in FIGS. 8B-8C.

As shown in FIG. 8B, an airflow 820 generally flows at a distance d1 from the heater 300 due to the length of the apertures 296 of the end cap 280 extending in a direction normal to a circumferential axis of the second circular portion 286. By contrast, an airflow 830 generally flows at a distance d2 from the heater 300 due to the length of the apertures 296 of the end cap 280 extending in a direction along and/or in parallel to a circumferential axis of the second circular portion 286 and the apertures 810 being at the outer most edge of the second circular portion 286. The distance d2 is greater than the distance d1. At distance d2, the air is moving through a region of the substrate that is further away from the heater surface, and is therefore a cooler region of the substrate.

As a result, a generated aerosol 835 exits a capsule 840 at a lower temperature than a generated aerosol 825 exiting a capsule 845. The capsule 845 is the same as the capsule shown in FIGS. 2A-3A and the capsule 840 is the same as the capsule shown in FIGS. 2A-3A with the end cap 800 instead of the end cap 280. As stated, above, the apertures may be arranged differently than shown in FIGS. 2A-3A and FIG. 8, to generate a different desired air flow pattern and temperature.

Figure 9B:
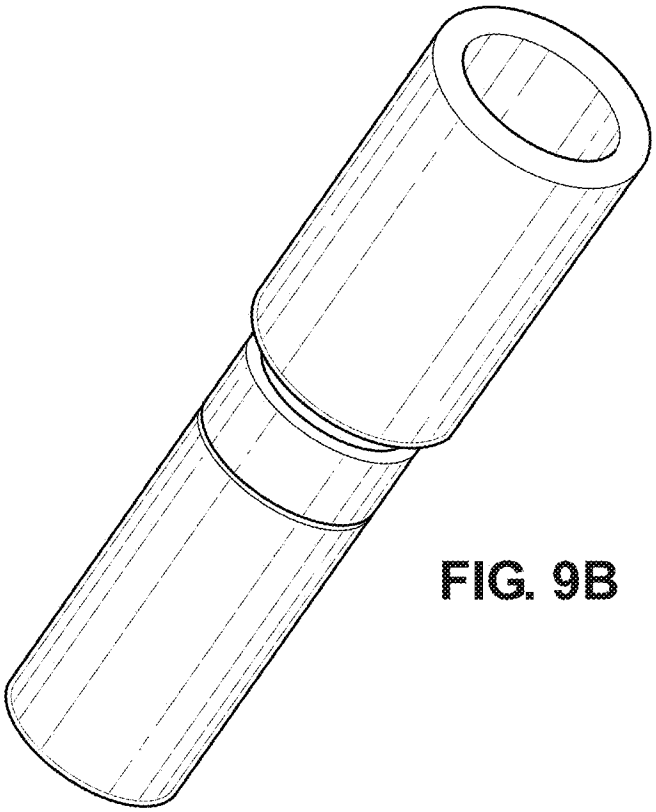
FIGS. 9A-9C illustrate a capsule and a mouthpiece according to at least one example embodiment.
Figure 9A:
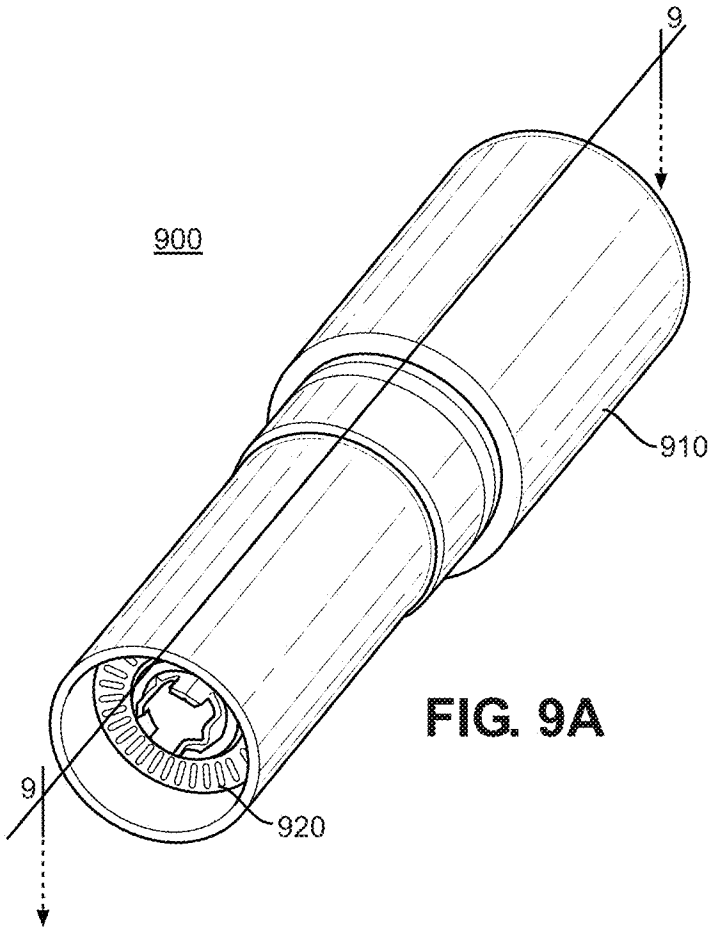
Figure 9C:
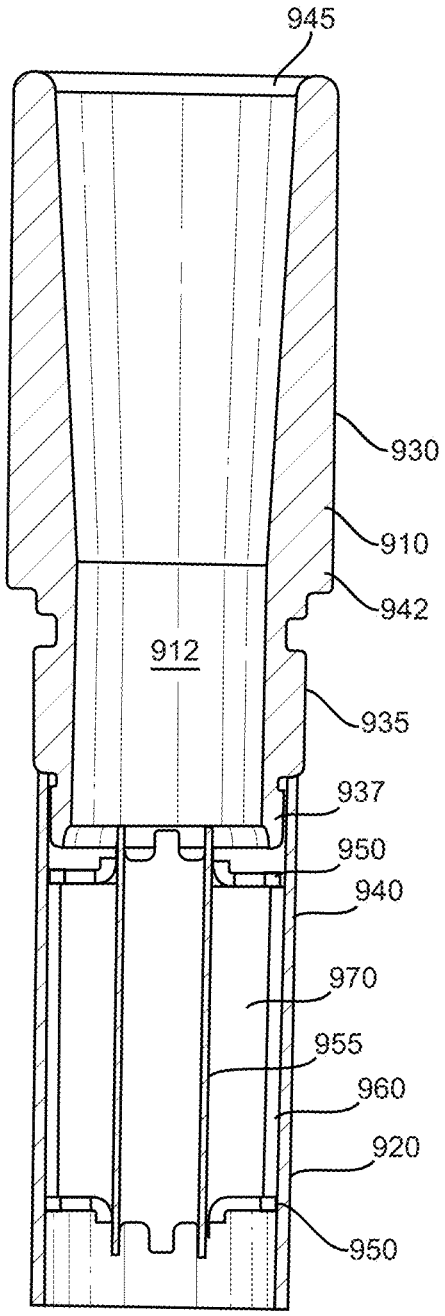

FIGS. 9A-9C illustrate an example embodiment of a capsule integrated into a mouthpiece. FIG. 9A illustrates a first perspective view of an integrated capsule and mouthpiece 900. FIG. 9B illustrates a second perspective view of the integrated capsule and mouthpiece 900. FIG. 9C illustrates a cross-sectional view of the integrated capsule and mouthpiece 900 along the line 9-9.

As shown in FIGS. 9A and 9C, an integrated mouthpiece includes a mouthpiece 910 and a capsule 920. The mouthpiece 910 defines a channel 912 that interfaces with the capsule 920. In the example embodiment shown in FIGS. 9A and 9C, the mouthpiece 910 is cylindrical. However, in other example embodiments, the mouthpiece may be another shape such as a rectangular prism.

The mouthpiece 910 includes a first cylindrical portion 930, a second cylindrical portion 935 and a third cylindrical portion 937.

The mouthpiece 910 may a recyclable and/or a degradable material such as aluminum, cardboard or a biological polymer. Moreover, the aluminum may be uncoated. However, a cardboard mouthpiece may be coated with a polymer. In some example embodiments, the mouthpiece 910 may include a sticker on the outer surface to maintain structural integrity of the mouthpiece 910.

As shown in FIG. 9C, the channel 912 gradually increases in diameter from a first end 942 of the first cylindrical portion 930 to an outlet end 945 of the mouthpiece 910.

The capsule 920 may be coupled to the mouthpiece 910 by a friction fit. The capsule 920 includes an outer cylindrical wall 940. An inner diameter of the outer cylindrical wall 940 may be dimensioned such that the third cylindrical portion 937 may be inserted into a space within the outer cylindrical wall 940 and form a friction fit. While example embodiments have been described with regards to a cylindrical shaped friction fit, it should be understood example embodiments are not limited thereto.

The mouthpiece 910 and the capsule 920 are coupled such that air flowing through the apertures of the capsule 920, enters the channel 912 and exits the outlet 945, when a negative pressure is applied.

The capsule 920 includes an inner body 955 and an outer body 960. Like the example embodiments described with reference to FIGS. 2A-7C, the inner body 955 and the outer body 960 are concentric. The inner body 955 may be the same as the inner body 700.

In the example embodiments shown in FIG. 9C, the outer body 960 defines an entire length of the cavity 970. End caps 950 are placed over both ends of the outer body 960. The end caps 950 are attached to the inner body 955 by swaging and folding the inner tube 955 over a portion of the end caps 950.

Figure 10A:
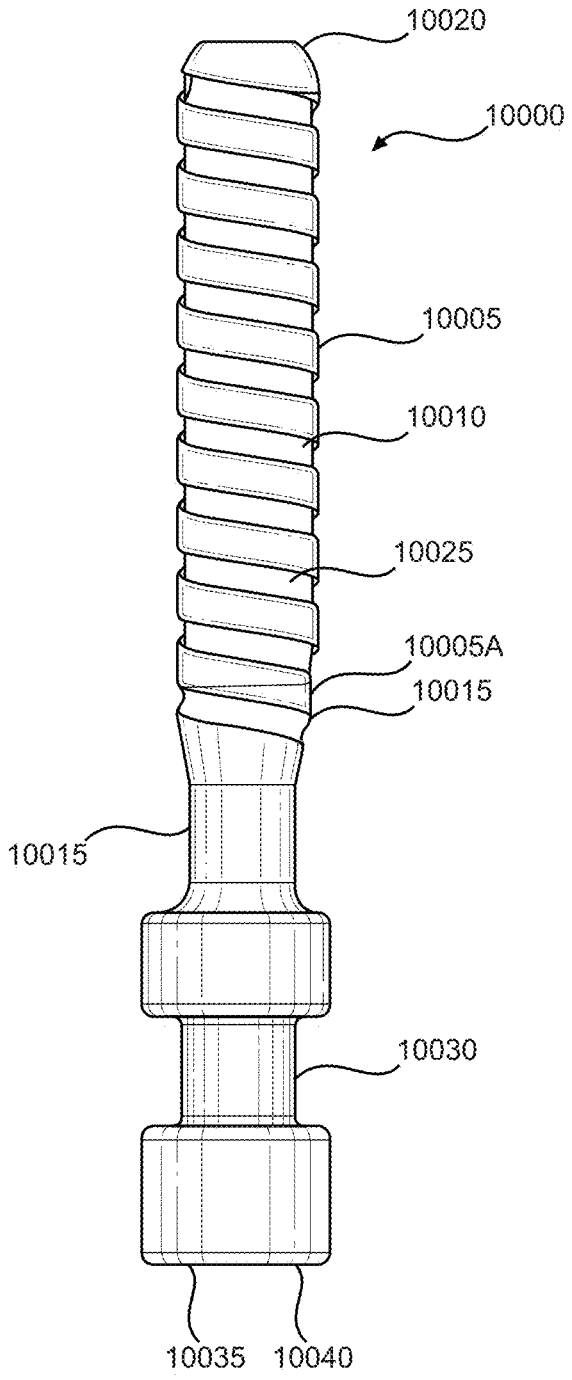
FIGS. 10A-10B illustrate example embodiments of a heater.

FIG. 10A illustrates an example embodiment of a heater. A heater 10000 can be used in the capsules according to example embodiments. As shown, the heater 10000 includes a flat region 10005 and a grooved region 10010. Both the flat region 10005 and the grooved region 10010 extend from a neck portion 10015 of the heater 10000 to a tapered portion 10020 at an opposing end of the heater 10000

Both the flat region 10005 and the grooved region 10010 extend along the heater 10000 in a spiral fashion such that flat segments 10005*a* and grooved segments 10010 *a* alternate when viewed from a side. A heater wire 10025 is placed within the grooved region 10010. The heater wire 10025 creates a minor diameter of the heater 10000 that may not contact the capsule when the heater 10000 is inserted into the capsule. The flat region 10005 defines a major diameter of the heater 10000 and contacts the capsule when the heater 10000 is inserted into the capsule. The heater 10000 may further include a mounting portion 10030 to mount the heater 10000 to a holder for the heater.

The flat region 10005 and the grooved region 10010 may be made from the same piece of material, which may be a high temperature material such as a ceramic.

Wires 10035 and 10040 extend through the holder and connect to or form a part of the heater wire 10025.

Figure 10B:
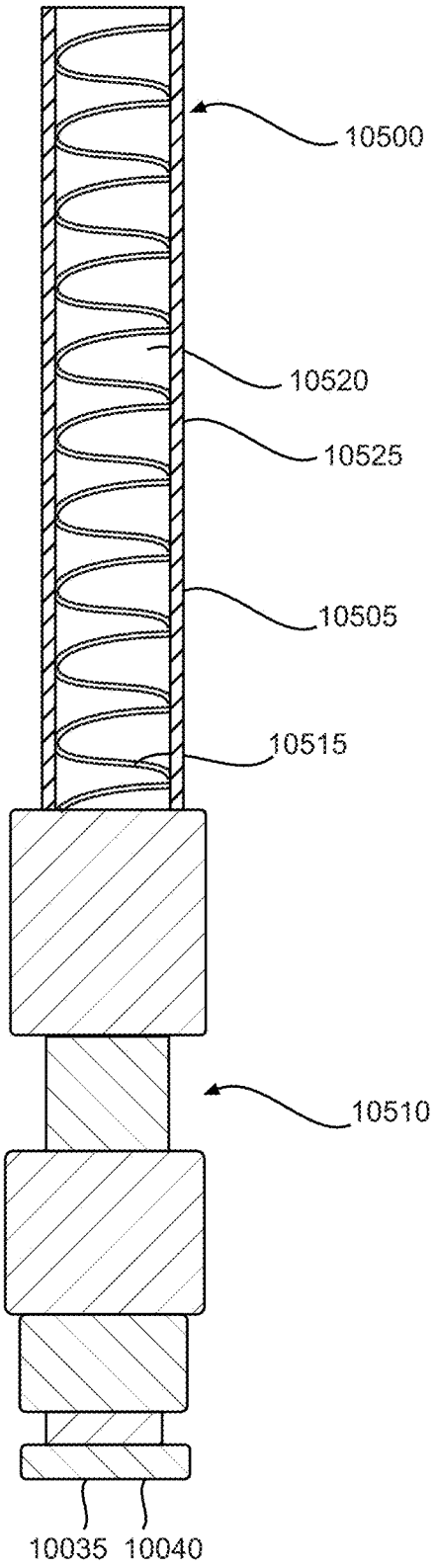

FIG. 10B illustrates an example embodiment of a heater. A heater 10500 can be used in the capsules according to example embodiments. The heater 10500 includes a glass tube 10505 and a holder 10510 holding the glass tube 10505. The glass tube 10505 may be cylindrical, but is not limited thereto. For example, the glass tube 10505 may be shaped to be inserted into a capsule and, thus, the shape of the glass tube 10505 may correspond to a shape of an inner space (e.g., space 265) within an inner body (e.g., inner body 250) of the capsule. A spiral heater 10515 extends within a cavity 10520 that is defined by a wall 10525 of the glass tube 10505. The spiral heater 10515 may extend the entire length of the glass tube 10505. Portions of the spiral heater 10515 contact the glass tube 10505. As a result, the spiral heater 10515 transfers heat to the glass tube 10505 when the spiral heater 10515 generates heat.

Wires 10535 and 10540 extend through the holder 10510 and connect to or form a part of the spiral heater 10515.

Figure 11:
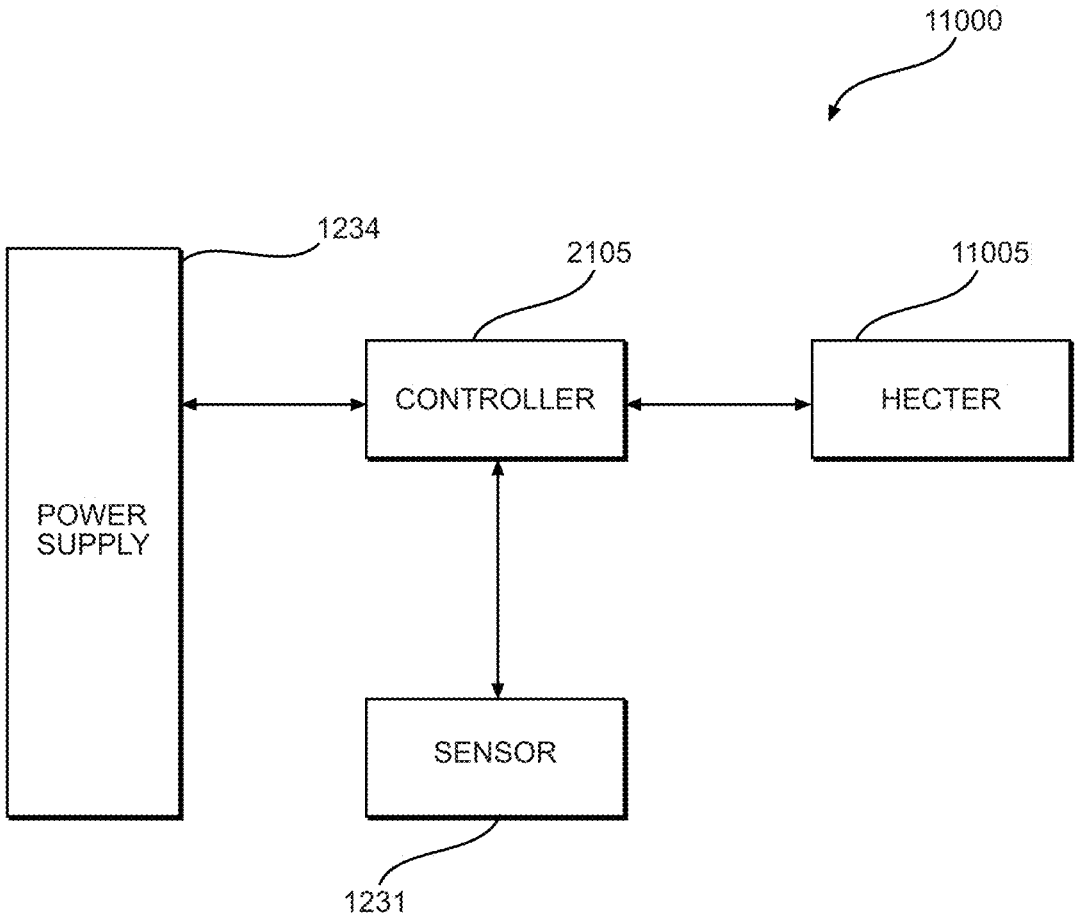
FIG. 11 illustrates a block diagram of a control system of a device according to at least one example embodiment.

FIG. 11 illustrates a block diagram of a control system of a device according to at least one example embodiment. In an example embodiment, a control system 11000 includes the controller 2105 that is operationally connected to the power supply 1234 and the sensor 1231. In an example embodiment, the controller 2105 receives an input signal, or signals, from the sensor(s) 1231, and the controller 2105 controls operations of the aerosol-generating device 10, including supplying an electrical current from the power supply 1234 to the heater 11005 to heat the aerosol-generating substrate based at least in part on the signal(s) from the sensor(s) 1231. The heater 11005 may be any heater described in accordance with example embodiments, e.g., the heater 1300 and/or the heater 300.

In an example embodiment, the control system 11000 is operationally and electrically connected to the heater via the electric connector 1236*a* that allows the control system 11000 to selectively send the electrical current to the heater 11005.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. A capsule for an aerosol-generating device, comprising:

an inner body defining an inner receiving area and including a rolled sheet forming a spring biased plurality of layers, the inner receiving area configured to receive a heater;

an outer body around the inner body, the inner body and the outer body being concentric, the inner body and the outer body at least partly defining a cavity, the cavity and the inner receiving area being on opposing sides of the spring biased plurality of layers such that the spring biased plurality of layers at least partially defines the cavity and the spring biased plurality of layers at least partially defines the inner receiving area;

an aerosol-forming substrate in the cavity;

a first cap at a first end of the cavity; and a second cap at a second end of the cavity, the first and second caps being configured to permit air flow from the first end of the cavity to the second end of the cavity.

2. The capsule of claim 1, wherein the inner body has a higher heat conductivity than the outer body.

3. The capsule of claim 1, wherein the second cap includes a plurality of apertures in a circular pattern.

4. The capsule of claim 1, wherein the second cap includes a plurality of apertures, a length of the plurality of apertures being normal to a radius of the second cap.

5. The capsule of claim 1, wherein the second cap includes a plurality of apertures, a length of the plurality of apertures being in a radial direction of the second cap.

6. The capsule of claim 1, wherein the inner body is on the second cap.

7. The capsule of claim 1, wherein the inner body includes a metal.

8. The capsule of claim 1, wherein the inner body includes paperboard, plastic, or a combination thereof.

9. An aerosol-generating device, comprising:

a capsule, the capsule including, an inner body, the inner body defining an inner space and including a rolled sheet forming a spring biased plurality of layers;

an outer body around the inner body, the inner body and the outer body being concentric, the inner body and the outer body at least partly defining a cavity, the cavity and the inner space being on opposing sides of the spring biased plurality of layers such that the spring biased plurality of layers at least partially defines the cavity and the spring biased plurality of layers at least partially defines the inner space;

an aerosol-forming substrate in the cavity;

a first cap at a first end of the cavity; and a second cap at a second end of the cavity, the first and second caps being configured to permit air flow from the first end of the cavity to the second end of the cavity; and a heater dimensioned to fit in the inner space and contact the inner body, the heater being configured to heat the inner body to generate an aerosol from the aerosol-forming substrate.

10. The aerosol-generating device of claim 9, wherein the inner body has a higher heat conductivity than the outer body.

11. The aerosol-generating device of claim 9, wherein the second cap includes a plurality of apertures in a circular pattern.

12. The aerosol-generating device of claim 9, wherein the second cap includes a plurality of apertures, a length of the plurality of apertures being normal to a radius of the second cap.

13. The aerosol-generating device of claim 9, wherein the second cap includes a plurality of apertures, a length of the plurality of apertures being in a radial direction of the second cap.

14. The aerosol-generating device of claim 9, wherein the inner body is on the second cap.

15. The aerosol-generating device of claim 9, wherein an inner diameter of the inner body expands to correspond to a diameter of the heater upon insertion of the heater.

16. The aerosol-generating device of claim 9, further comprising:

a mouthpiece coupled to the capsule.

17. The aerosol-generating device of claim 9, wherein the inner body includes metal.

18. The aerosol-generating device of claim 9, wherein the inner body includes paperboard, plastic, or a combination thereof.

* * * * *